US007848678B2

(12) United States Patent
Shibata et al.

(10) Patent No.: US 7,848,678 B2
(45) Date of Patent: Dec. 7, 2010

(54) IMAGE FORMING APPARATUS AND PROCESS CARTRIDGE

(75) Inventors: Junichi Shibata, Kanagawa (JP); Makoto Nishimura, Kanagawa (JP); Takahiro Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 449 days.

(21) Appl. No.: 12/052,376

(22) Filed: Mar. 20, 2008

(65) Prior Publication Data

US 2009/0060574 A1 Mar. 5, 2009

(30) Foreign Application Priority Data

Aug. 29, 2007 (JP) ..... 2007-222500

(51) Int. Cl.
*G03G 15/02* (2006.01)
*G03G 15/00* (2006.01)

(52) U.S. Cl. ..... 399/128; 399/50; 399/159; 399/158; 399/169; 399/170

(58) Field of Classification Search ..... 399/50, 399/128, 168, 169
See application file for complete search history.

(56) References Cited

U.S. PATENT DOCUMENTS 4,728,982 A * 3/1988 Takemura ..... 399/186
5,030,992 A * 7/1991 Yoneda et al. ..... 399/186
5,480,627 A * 1/1996 Takei et al. ..... 430/127
5,514,504 A * 5/1996 Iijima et al. ..... 430/20
5,721,042 A * 2/1998 Iijima et al. ..... 428/195.1
5,750,238 A * 5/1998 Iijima et al. ..... 428/195.1
6,678,491 B2 * 1/2004 Kido et al. ..... 399/128
6,738,588 B2 * 5/2004 Yokomori et al. ..... 399/111
7,319,835 B2 * 1/2008 Ahn ..... 399/129
7,498,559 B2 * 3/2009 Nishimura et al. ..... 250/216
7,592,112 B2 * 9/2009 Shiino et al. ..... 430/59.1

(Continued)

FOREIGN PATENT DOCUMENTS

JP A-58-008696 1/1983

(Continued)

OTHER PUBLICATIONS

Japanese Office Action issued in Japanese Patent Application No. 2007-222500 on Jan. 5, 2010 (with English-language translation).

*Primary Examiner*—David M Gray
*Assistant Examiner*—Francis Gray
(74) *Attorney, Agent, or Firm*—Oliff & Berridge, PLC

(57) ABSTRACT

An image forming apparatus comprising an image holding member that is rotationally driven, the image holding member comprising, on a substrate, a subbing layer and a photosensitive layer, a volume resistance value of the subbing layer decreasing in a rotation axis direction of the image holding member, from one end portion of a light source side of the image holding member towards another end portion of the image holding member, a charging unit, a latent image formation unit, a developing unit, a transfer unit, and a charge removal unit comprising a light source that, after transfer of the toner image, irradiates the surface of the image holding member from one side thereof, in a rotation axis direction of the image holding member, with charge removing light, to remove the charge from the surface of the image holding member.

18 Claims, 4 Drawing Sheets

U.S. PATENT DOCUMENTS

2006/0014090 A1* 1/2006 Shiino et al. ..... 430/59.1
2007/0264047 A1* 11/2007 Kurimoto et al. ..... 399/159

FOREIGN PATENT DOCUMENTS

JP A-63-221354 9/1988
JP A 2001-142365 5/2001
JP A 2006-30856 2/2006
JP A 2006-178002 7/2006
WO WO 2005/073814 A1 8/2005

* cited by examiner

IMAGE FORMING APPARATUS AND PROCESS CARTRIDGE

CROSS-REFERENCE TO RELATED APPLICATION

This application is based on and claims priority under 35 USC 119 from Japanese Patent Application No. 2007-222500 filed Aug. 29, 2007.

BACKGROUND

1. Technical Field

This invention is related to an image forming apparatus and a process cartridge.

2. Related Art

An image forming apparatus employing an electrophotographic method has been known as an image forming apparatus used in copying machines and printers that form color or black and white images.

In this type of an image forming apparatus, an image is formed on a recording medium by charging the surface of a photoreceptor by a charging unit; exposing the charged surface in an imagewise manner to form an electrostatic latent image on the photoreceptor; developing the electrostatic latent image with a toner to form a toner image; and transferring the toner image onto the recording medium directly or via an intermediate transferring unit. The surface of the photoreceptor after completion of transferring the toner image is charged again by the charging unit, and the aforementioned steps of forming an electrostatic latent image and a toner image are repeated.

In the image forming apparatus employing an electrophotographic method, there is a problem of incurring an image defect, so-called ghosting, which is an appearance of an exposure record formed at the previous image formation process on a newly formed image, caused by a charge remaining on the surface of the photoreceptor after completion of transferring a toner image.

SUMMARY

According to an aspect of the invention, there is provided an image forming apparatus comprising:

an image holding member that is rotationally driven, the image holding member comprising, on a substrate, a subbing layer and a photosensitive layer, a volume resistance value of the subbing layer decreasing in a rotation axis direction of the image holding member, from one end portion of a light source side of the image holding member towards another end portion of the image holding member;

a charging unit that charges a surface of the image holding member;

a latent image formation unit that forms an electrostatic latent image on the image holding member by exposing to light the surface of the image holding member that has been charged by the charging unit;

a developing unit that forms a toner image corresponding to the electrostatic latent image on the image holding member by developing the electrostatic latent image with a toner;

a transfer unit that transfers the toner image onto an image receiving member; and a charge removal unit comprising a light source that, after transfer of the toner image, irradiates the surface of the image holding member from one side thereof, in a rotation axis direction of the image holding member, with charge removing light, to remove the charge from the surface of the image holding member.

BRIEF DESCRIPTION OF THE DRAWINGS

Exemplary embodiments of the invention will be described in detail based on the following figures, wherein.

DETAILED DESCRIPTION

In the following, an image forming apparatus according to a first exemplary embodiment of the invention will be described.

First Exemplary Embodiment

Figure 1:
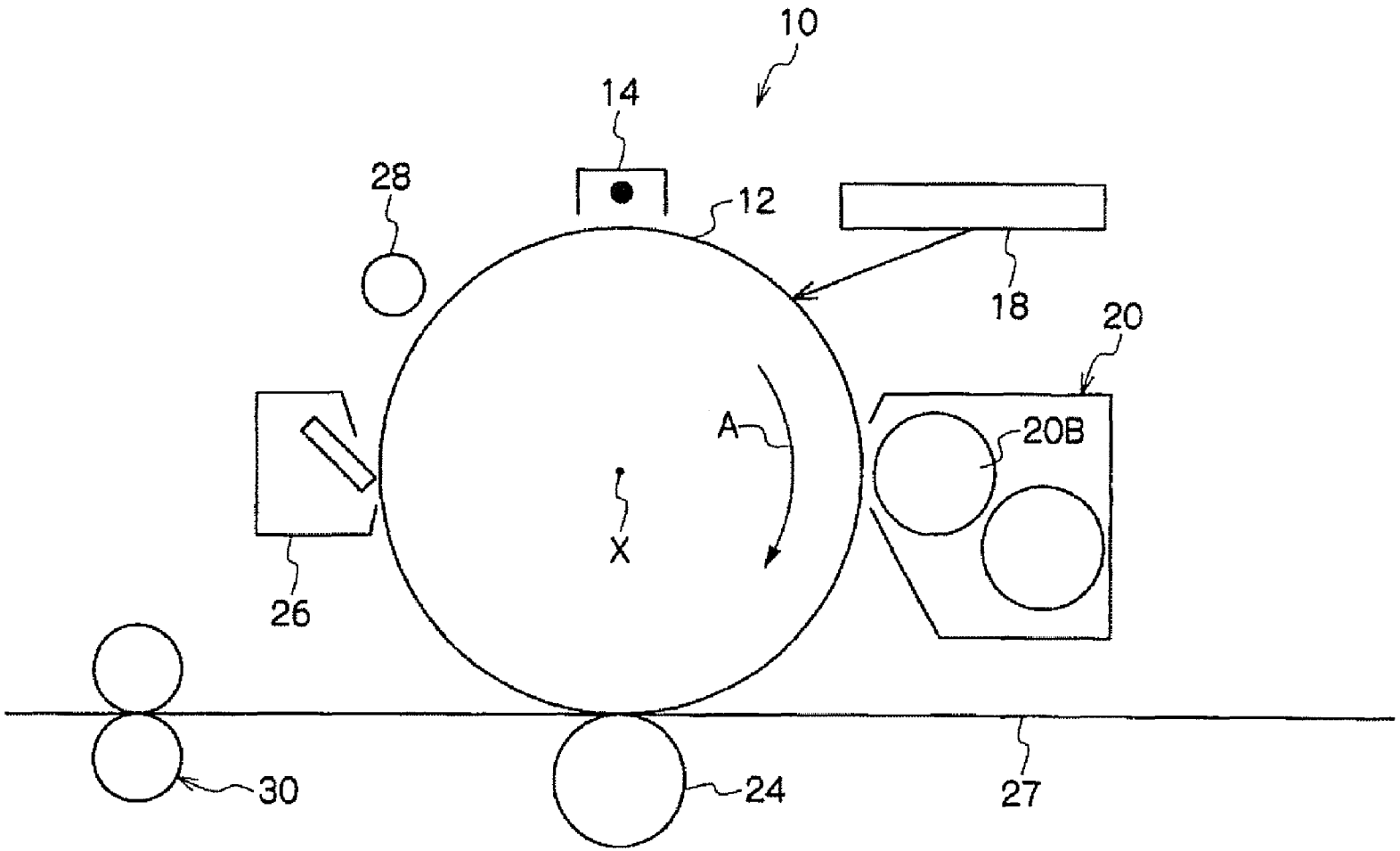
FIG. 1 is a schematic view of an exemplary embodiment according to an image forming apparatus of a first exemplary embodiment.

An image forming apparatus 10 according to an first exemplary embodiment includes a photoreceptor 12 as shown in FIG. 1. The photoreceptor 12 has a cylindrical shape and is rotatably provided so as to be rotated in the specified direction around the rotation axis X (the direction of arrow A in FIG. 1). Around the photoreceptor 12, a charging unit 14, an exposure unit 18, a developing unit 20, a transfer unit 24, a cleaning unit 26, and a charge removal unit 28 are arranged in this order along the rotation direction of the photoreceptor 12 (the direction of arrow A in FIG. 1).

In the first exemplary embodiment, the image forming apparatus 10 corresponds to the image forming apparatus of the invention; the charging unit 14 corresponds to the charging unit of the image forming apparatus of the invention; the photoreceptor 12 corresponds to the image holding member of the image forming apparatus of the invention; the exposure unit 18 corresponds to the latent image forming unit of the image forming apparatus of the invention; the developing unit 20 corresponds to the developing unit of the image forming apparatus of the invention; and the charge removal unit 28 corresponds to the charge removal unit of the image forming apparatus of the invention.

The charging unit 14 charges the surface of the photoreceptor 12 to a predetermined potential. Known charging devises may be used as the charging unit 14. Examples of the usable charging devises include those of a contact type such as roll, brush, magnetic brush, and blade chargers; and those of a non-contact type such as corotron and scorotron chargers.

In a contact charging method, the surface of the photoreceptor 12 is charged by applying a voltage to a conductive member in contact with the surface of the photoreceptor 12.

The shape of the conductive member may be any of a brush, blade, pin electrode, roller, and the like, and is particularly preferably a roller shape. The roller-shaped member is usually composed of, from the outside thereof, a resistive layer, an elastic layer supporting the resistive layer, and a core member. As necessary, a protective layer may be provided on the outer surface of the resistive layer.

In this exemplary embodiment, the term "conductive" means that the volume resistivity is $10^{10}$ Ω·cm or less.

The photoreceptor 12 is charged with a conductive member through application of a voltage to the conductive member. The applied voltage is preferably a direct current voltage, or a direct current voltage with an alternating voltage superimposed on the direct current voltage. The surface potential of the photoreceptor 12 upon charging is preferably −400 V or more and −200 V or less.

The exposure unit 18 exposes the photoreceptor 12, which has been charged by the charging unit 14, to light (exposure light) to which the photoreceptor 12 is sensitive, thereby forming an electrostatic latent image on the photoreceptor 12 according to the image data of the image to be formed by the image forming apparatus 10.

The exposure unit 18 may be a known exposure unit as long as it is capable of exposing the photoreceptor 12 to exposure light. The exposure unit 18 may be, for example, an optical unit capable of emitting light in the form of an intended image, and examples of the light source employed in the optical unit include a semiconductor laser, an LED (light emitting diode), and a liquid crystal shutter.

In cases where an LED is used as the light source, the exposure light preferably has a wavelength of 500 nm or more and 800 nm or less. By using an LED as the light source, no interference light is formed in the photoreceptor 12, and occurrence of wood grain density variations can be avoided.

The developing unit 20 develops the electrostatic latent image with a toner (details of which will be described later), thereby forming a toner image on the photoreceptor 12 corresponding to the electrostatic latent image.

The developing unit 20 is composed of a development roll 20B that holds the reserved toner and supplies the toner held thereon to the surface of the photoreceptor 12, and a developing bias voltage applying unit (not shown) that applies a developing bias voltage to the development roll 20B.

The developing unit 20 may be a known developing unit 20. The development method may be any of a two-component development method using a carrier and a toner, a one-component development method using a toner alone, and modifications thereof wherein additional component(s) are added for improving development and other properties, and the like.

The transfer unit 24 transfers the toner image from the photoreceptor 12 onto a recording medium 27. The transfer unit 24 may be a known transfer unit, and examples thereof include those of a contact type such as a roll, a brush, and a blade, and those of a non-contact type include corotron, scorotron, and pin corotron transfer units. The transfer may be carried out by pressure, or combination of pressure and heat. The transfer voltage is preferably +300 V or more and +700 V or less. The transfer unit 24 may have a structure in which transfer is carried out under a constant voltage control system.

The recording medium 27 reserved in a recording medium supplying unit (not shown) is conveyed by, for example, a conveyor roll (not shown) to a portion at which the photoreceptor 12 and the transfer unit 24 face each other, and then conveyed by the photoreceptor 12 and the transfer unit 24 in a sandwiched manner therebetween, whereby the toner image is transferred from the photoreceptor 12 onto the recording medium 27.

In this exemplary embodiment, the recording medium 27 is conveyed by the photoreceptor 12 and the transfer unit 24 in a sandwiched manner therebetween, whereby the toner image is transferred to the recording medium 27. However, the image forming apparatus 10 is not limited to that form, and the toner image formed on the photoreceptor 12 may be transferred onto an intermediate transfer member (not shown) such as an intermediate transfer belt, and then transferred onto the recording medium 27.

The intermediate transfer member may be made from a known conductive thermoplastic resin. Examples of the conductive thermoplastic resin include those containing a conductive agent, such as polyimide resins, polycarbonate resin (PC), polyvinylidene fluoride (PVDF), polyalkylene terephthalate (PAT), and blend materials such as ethylene-tetrafluoroethylene copolymer (ETFE)/PC, ETFE/PAT, and PC/PAT. Among them, polyimide resins containing a conductive agent dispersed therein are preferable from the viewpoint of excellent mechanical strength. The conductive agent may be carbon black, a metal oxide, or a conductive polymer such as polyaniline. The intermediate transfer member may have a surface layer.

The cleaning unit 26 (toner removal unit) removes residual toner or foreign substances such as paper powder from the photoreceptor 12 after transferring the toner image onto the recording medium 27. The cleaning unit 26 preferably has a cleaning member such as a magnetic brush, a conductive fiber brush, or a blade. The material of the cleaning blade may be, for example, urethane rubber, neoprene rubber, or silicone rubber.

After transferring the toner image held on the photoreceptor 12 onto the recording medium 27 by the transfer unit 24, the photoreceptor 12 is further rotated to have foreign substances removed from the surface of the photoreceptor 12 by the cleaning unit 26.

The charge removal unit 28 removes residual charges from the photoreceptor 12.

Figure 2:
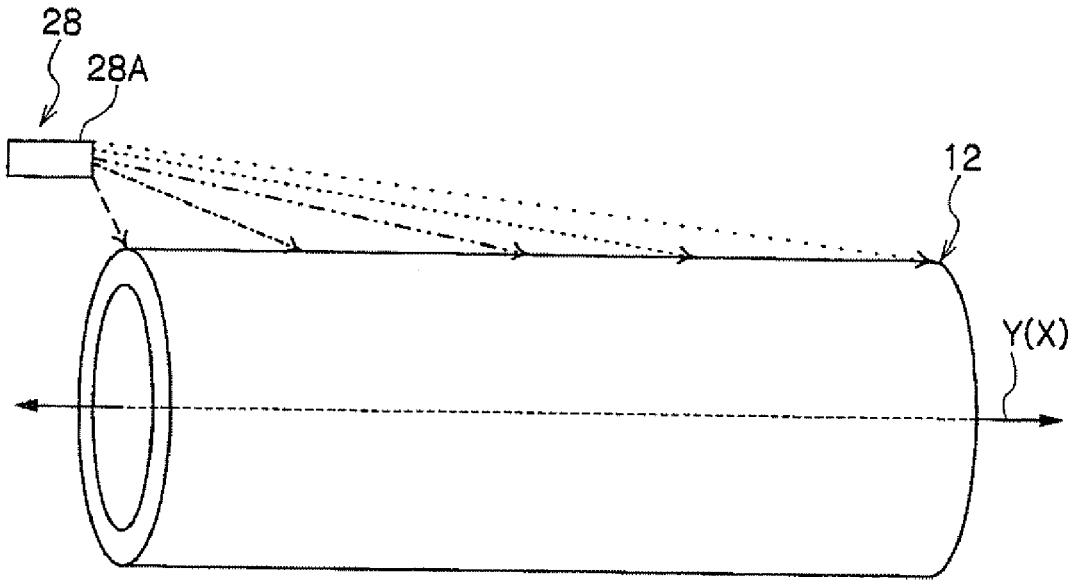
FIG. 2 is a schematic view illustrating a positional relationship of a photoreceptor and a charge removing light source according to an image forming apparatus of a first exemplary embodiment.

As shown in FIG. 2, the charge removal unit 28 includes a charge removing light source 28A that emits charge removing light for removing charges from the circumference surface of the photoreceptor 12.

The charge removing light source 28A of the charge removal unit 28 is provided on one end portion of the photoreceptor 12 in the direction of the rotation axis X (hereinafter referred to as the rotation axis direction Y, see FIG. 2) so that the light source may emit charge removing light to irradiate at least an area from which charges are to be removed, out of the area ranging one end to the other end of the photoreceptor 12 in the rotation axis direction Y (the area including at least a portion onto which a toner image can be formed by the developing unit 20 in the whole surface area of the photoreceptor 12).

More specifically, as shown in FIG. 2, the charge removing light source 28A of the charge removal unit 28 is provided at a position from which the charge removing light source 28A can irradiate the surface of the photoreceptor 12 with charge removing light, from one end to another end of the photoreceptor 12 in the rotation axis direction Y.

Consequently, the charge removing light source 28A of the charge removal unit 28 is provided outside the region of the photoreceptor 12 from which charges are to be removed (provided on the side away from the center of the photoreceptor 12 in the rotation axis direction Y), and emits charge removing light from the abovementioned position toward the region from which charges are to be removed, from one side to the other side of the surface of the photoreceptor 12 in the rotation axis direction Y. The photoreceptor 12 is rotated around the rotation axis X while being irradiated with charge removing light by the charge removal unit 28 in the rotation axis direction Y of the photoreceptor 12, whereby the charges on the surface of the photoreceptor 12 are removed by the charge removing light emitted from the charge removal unit 28.

The charge removing light source 28A may be any type of light source as long as it has an ability of removing charges based on an electrophotographic theory, and specific examples thereof include an LED and a halogen lamp.

The charge removal unit 28 may be provided with a light blocking member (not shown) that prevents the two ends of the photoreceptor 12 in the rotation axis direction Y, which are outside the region from which charges are to be removed, from being irradiated with the charge removing light emitted from the charge removing light source 28A toward the surface of the photoreceptor 12.

After foreign substances on the surface have been removed by the cleaning unit 26, the photoreceptor 12 is further rotated in the rotation direction (the direction of arrow A in FIG. 1) to have residual charges removed by the charge removal unit 28. Thereafter, the photoreceptor 12 is charged again by the charging unit 14.

The image forming apparatus 10 includes a fixing unit 30 that fixes the transferred toner image onto the recording medium 27. The fixing unit 30 may be any known fixing unit.

After the toner image has been transferred onto the recording medium 27 by the transfer unit 24, the recording medium 27 is then conveyed to the fixing unit 30 by means of, for example, conveyor rolls (not shown). The toner image on the recording medium 27 is fixed by the fixing unit 30 to form an image on the recording medium 27. The recording medium 27 after having the image formed thereon is conveyed out from the image forming apparatus 10 by means of, for example, conveyor rolls (not shown).

(Photoreceptor)

In the following, the photoreceptor 12 provided in the image forming apparatus 10 according to this exemplary embodiment is further described in detail.

Figure 3:
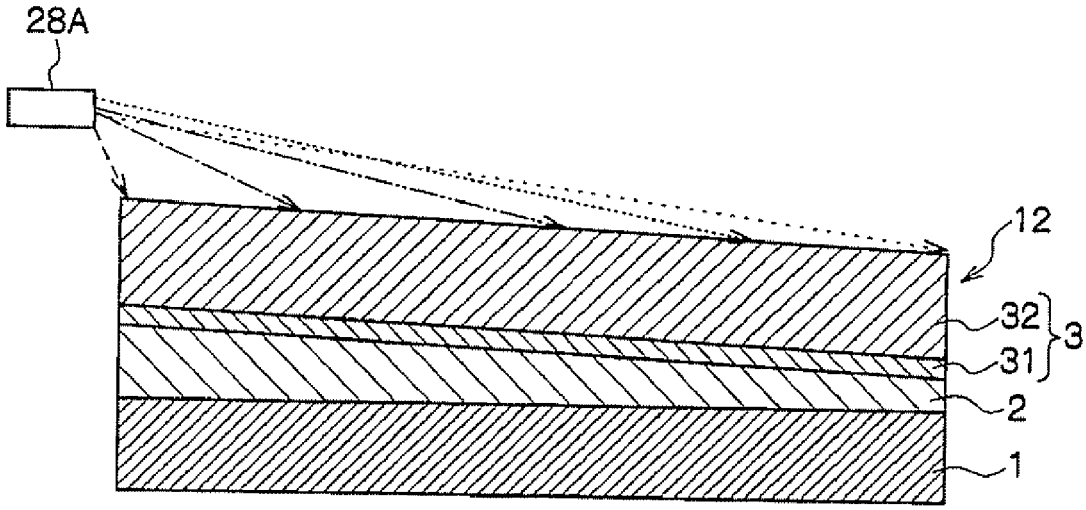
FIG. 3 is a schematic view illustrating a positional relationship of a photoreceptor and a charge removing light source, and a schematic structure of the photoreceptor according to an image forming apparatus of a first exemplary embodiment.

As shown in FIG. 3, the photoreceptor 12 includes at least a conductive substrate 1, and onto which a subbing layer 2 and a photosensitive layer 3 are laminated in this order. Detailed structure of the photoreceptor 12 will be described later. The photoreceptor 12 shown in FIG. 3 is a function-separated photoreceptor in which the photosensitive layer 3 is composed of a charge generating layer 31 and a charge transporting layer 32.

The conductive substrate 1 may be, for example, a metal drum made of aluminum, copper, iron, stainless steel, zinc, nickel and the like; or a sheet, paper, plastic, or glass that is imparted with conductivity by depositing a metal such as aluminum, copper, gold, silver, platinum, palladium, titanium, nickel-chromium, stainless steel, and indium, or a conductive metal compound such as indium oxide or tin oxide, laminating with a metal foil, or coating with a binder resin dispersing carbon black, indium oxide, tin oxide, antimony oxide powder, metal powder, copper iodide and the like.

The shape of the conductive substrate 1 is not limited to a drum, and may be a sheet, a plate or the like. When the conductive substrate 1 is in the form of a metal pipe, the surface of the substrate may or may not be treated by, for example, mirror finishing, etching, anodization, rough machining, centerless grinding, sandblasting, or wet honing.

When a metal drum is used for the conductive substrate 1, the outer surface (the side onto which the subbing layer 2 is formed) may or may not be treated by, for example, mirror finishing, etching, anodization, rough machining, centerless grinding, sandblasting, wet honing or coloring. Performing roughing treatment serves to prevent the surface of the substrate onto which the subbing layer 2 is to be provided from wood grain density variations (blotches) caused by interference light that may occur within the photoreceptor when a coherent light source such as a laser beam is used.

(Subbing Layer)

The subbing layer 2 has various functions of improving electrical properties, image quality, image quality maintainability, adhesiveness to the photosensitive layer 3, leak resistance, and the like. The subbing layer 2 is formed by applying the below-described subbing layer forming coating solution onto the conductive substrate 1.

The volume resistance value of the subbing layer 2, when included in the photoreceptor 12 and mounted on the image forming apparatus 10, decreases from the one end portion of the side of the charge removing light source 28A toward the other end portion in the rotation axis direction Y (more specifically, decreases in a direction from the end closer to the charge removing light source 28A toward the end away from the charge removing light source 28A).

In this exemplary embodiment, the measurement of the "volume resistance value" is carried out at each test piece of the subbing layer 2. The test pieces are obtained by cutting out in the shape of 1 cm×1 cm square, respectively, from at least five portions located from one end to the other end of the subbing layer 2, when included in the photoreceptor 12, in the rotation axis direction Y. Specifically, the volume resistance value of each test piece is determined according to JIS K6911, by applying a voltage adjusted to give an electric field of 1000 V/cm (applied voltage/composition sheet thickness) to the test piece for 30 seconds in an environment of a temperature of 24° C. and a relative humidity of 50%, and the calculating the volume resistance value by dividing the value of the applied voltage by the current value after the application of the voltage for 30 seconds. The measurement is conducted using a measurement tool (R12702A/B Resistivity Chamber, manufactured by Advantest Corporation) and a high resistance meter (R8340A digital high resistance/minute ammeter, manufactured by Advantest Corporation).

As will be described later, in this exemplary embodiment, the "volume resistivity" is determined by: preparing the subbing layer 2 in the form of a sheet, applying thereto a voltage adjusted to give an electric field of 1000 V/cm (applied voltage/composition sheet thickness) for 30 seconds using a measurement tool (R12702A/B Resistivity Chamber, manufactured by Advantest Corporation) and a high resistance meter (R8340A digital high resistance/minute ammeter, manufactured by Advantest Corporation), and then calculating the volume resistivity by the following formula on the basis of the applied voltage and the current value after the application of the voltage.

Volume resistivity (Ω·cm)=(19.63×applied voltage (V))/(current value (A)×composition sheet thickness (cm))

The subbing layer 2 exhibits a higher blocking performance against the conductive substrate at a portion with a higher volume resistance value as compared with a portion having a lower volume resistance value. Accordingly, the sensitivity to charge removing light at a portion corresponding to the portion with a higher volume resistance, when constituting the photoreceptor 12, is lower as compared with the sensitivity to charge removing light at a portion having a lower volume resistance value.

On the other hand, the subbing layer 2 exhibits a lower blocking performance against the conductive substrate at a portion with a lower volume resistance value as compared with a portion having a higher volume resistance value. Accordingly, the sensitivity to charge removing light at a portion corresponding to the portion with a lower volume resistance, when constituting the photoreceptor 12, is higher as compared with the sensitivity to charge removing light at a portion having a higher volume resistance value.

Since the charge removing light source 28A of the charge removal unit 28 is provided at one end portion of the photoreceptor 12 in the rotation axis direction Y, and emits charge removing light therefrom toward at least a region from which charges are to be removed, on the photoreceptor 12 in the rotation axis direction Y, the intensity of the charge removing light emitted from the charge removing light source 28A at a portion on the surface of the photoreceptor 12 decreases as the distance from the charge removing light source 28A increases in the rotation axis direction Y. The charge removal unit 28 is provided so as to satisfy the aforementioned positional relationship.

As mentioned above, in the image forming apparatus 10 according to this exemplary embodiment, the charge removing light source 28A is provided at one end portion of the photoreceptor 12 in the rotation axis direction Y, and therefore the intensity of the charge removing light emitted from the charge removing light source 28A is decreased at a portion on the surface of the photoreceptor 12 away from the charge removing light source 28A in the rotation axis direction Y. However, as described above, since the volume resistance value of the subbing layer 2 decreases in the rotation axis direction Y from the end portion closer to the charge removing light source 28A toward the other end portion, and thus the sensitivity of the photoreceptor 12 increases in the rotation axis direction Y from the end portion closer to the charge removing light source 28A toward the other end portion, the intensity of the charge removing light emitted toward the photoreceptor 12 can be prevented from being uneven in the rotation axis direction Y. Accordingly, occurrence of ghosting can be suppressed and deterioration in image quality can be avoided. The term "ghosting" refers to an image defect caused by formation of a residual image onto a newly formed image due to the exposure record of the previous image formation process. Hereinafter, the image defect may be referred to as "ghosting" as appropriate.

The volume resistance value at the farthest portion from the charge removing light source 28A in the rotation axis direction Y of the subbing layer 2 is preferably in the range of 1/100 or more and 1/10 or less, more preferably 1/90 or more and 1/20 or less, and particularly preferably 1/75 or more and 1/25 or less, of the volume resistance value at the closest portion to the charge removing light source 28A in the rotation axis direction Y of the subbing layer 2.

If the volume resistance value at the farthest portion from the charge removing light source 28A in the rotation axis direction Y on the subbing layer 2 is more than 1/10 of the volume resistance value at the closest portion to the charge removing light source 28A in the rotation axis direction Y of the subbing layer 2, the image density may be significantly lowered at the end of the effective photosensitive region, and if less than 1/100, the image density may be significantly increased at the end of the same.

In this exemplary embodiment, as shown in FIG. 3, a specific structure for regulating the volume resistance value of the subbing layer 2 so as to decrease from one end portion of the charge removing light source 28A to the other end portion is given such that the thickness of the subbing layer 2 decreases from one end portion of the charge removing light source 28A to the other end portion in the rotation axis direction Y.

By regulating the thickness of the subbing layer 2 as mentioned above, the volume resistance value of the subbing layer 2, when included in the photoreceptor 12 and mounted on the image forming apparatus 10, can be regulated so as to decrease from the one end portion closer to the charge removing light source 28A toward the other end portion in the rotation axis direction Y. The volume resistivity of the subbing layer 2, when included in the photoreceptor 12 and mounted on the image forming apparatus 10, is regulated to be constant or substantially constant in the rotation axis direction Y. The details of the volume resistivity will be described later.

In the subbing layer 2, when included in the photoreceptor 12 and mounted on the image forming apparatus 10, the thickness at the portion having the largest thickness in the rotation axis direction Y (the portion closest to the charge removing light source 28A) and the thickness at the portion having the smallest thickness in the rotation axis direction Y (the portion farthest from the charge removing light source 28A) are preferably different from the average thickness of the photoreceptor 12 in the rotation axis direction Y by an amount of 10% to 50%, or by an amount of about 10% to about 50%, of the average thickness of the photoreceptor 12 in the rotation axis direction Y.

If the thickness at the portion having the largest thickness and/or the thickness at the portion having the smallest thickness are different from the average thickness of the subbing layer 2 by an amount of less than 10%, or by an amount of less than about 10%, the film formation may be difficult from the viewpoint of mass production, and if the above thicknesses are different from the average thickness of the subbing layer 2 by an amount of more than 50%, or by an amount of more than about 50%, the volume resistivity may be difficult to be regulated to make it difficult to achieve the object of the invention.

In order to form the subbing layer 2 having a thickness, when included in the photoreceptor 12 and mounted on the image forming apparatus 10, that decreases from the one end portion closer to the charge removing light source 28A toward the other end portion in the rotation axis direction Y, an applicable method is to adjust the speed of applying a subbing layer forming coating solution (details of which will be described later) onto the conductive substrate 1 such that the thickness of the subbing layer 2 varies in the rotation axis direction Y.

In this exemplary embodiment, the thickness of the subbing layer 2, when included in the photoreceptor 12 and mounted on the image forming apparatus 10, may vary in a stepwise manner or in a continuous manner, as long as it decreases from the one end portion closer to the charge removing light source 28A toward the other end portion in the rotation axis direction Y. However, it is more preferable that the thickness decreases in a continuous manner since the image density without stepwise variation can be obtained.

As described above, in this exemplary embodiment, the thickness of the subbing layer 2, when included in the photoreceptor 12 and mounted on the image forming apparatus 10, is regulated to decrease from the one end portion closer to the charge removing light source 28A toward the other end portion in the rotation axis direction Y, so that the volume resistance value of the subbing layer 2, when included in the photoreceptor 12 and mounted on the image forming apparatus 10, may be regulated to decrease from the one end portion closer to the charge removing light source 28A toward the other end portion in the rotation axis direction Y.

The subbing layer 2 contains metal oxide particles. By including the metal oxide particles in the subbing layer 2, increase in electrical resistance of the layer can be suppressed even when with a small thickness, deterioration in electrical properties of the photoreceptor 12 due to repeated use can be prevented, and the resin proportion in the subbing layer 2 can be reduced to make the layer less vulnerable to short-wavelength light.

It is necessary that the metal oxide particles have a powder resistance of about $10^2$ Ω·cm or more and about $10^{11}$ Ω·cm or less, in order to obtain an adequate resistance for acquiring leak resistance. In particular, at least one kind of metal oxide particles having a resistance value in the above intended range selected from those of titanium oxide, zinc oxide, tin oxide, and zirconium oxide is preferably employed from the viewpoint of stability in electrical properties and image quality during repeated use over a long period of time. Among them, particles of zinc oxide and titanium oxide, having a high degree of electron mobility, are particularly preferable to achieve favorable electrophotographic properties.

If the resistance value of the metal oxide particles is lower than the lower limit of the above range, sufficient leak resistance may not be provided, and if higher than the upper limit of the above range, increase in the residual potential may be caused. Two or more kinds of the metal oxide particles having undergone different surface treatments, having different particle diameters, or the like, may be used in combination. The metal oxide particles preferably have a specific surface area of 10 $m^2/g$ or more as measured by the BET method. Those having a specific surface area of less than 10 $m^2/g$ tend to cause decrease in chargeability to make it difficult to achieve favorable electrophotographic properties. The volume average particle diameter of the metal oxide particles is preferably 50 nm or more and 200 nm or less.

The metal oxide particles are preferably subjected to a surface treatment. The surface treatment agent may be any known agent as long as it provides intended properties, and examples thereof include a silane coupling agent, a titanate coupling agent, an aluminum coupling agent, and a surfactant. In particular, a silane coupling agent is preferable because it provides favorable electrophotographic properties. Furthermore, a silane coupling agent having an amino group and a silane coupling agent having an unsaturated group are preferable from the viewpoints of, for example, imparting favorable blocking properties to the subbing layer, and preventing degradation of the metal oxide particles due to irradiation with light.

The silane coupling agent having an amino group may be arbitrarily selected as long as it provides intended photoreceptor properties, and specific examples thereof include, but are not limited to, γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxyethyl)-γ-aminopropyltriethoxysilane.

The silane coupling agent may be used in combination with other silane coupling agent(s). Examples of the silane coupling agent used in combination with the aforementioned silane coupling agent having an amino group include, but not limited to, vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyl triethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Examples of the silane coupling agent having an unsaturated group include, but are not limited to, vinyltrimethoxysilane, vinyltriethoxysilane, γ-methacryloxypropylmethyldimethoxysilane, γ-methacryloxypropyltriethoxysilane, and γ-methacryloxypropyltrimethoxysilane.

The surface treatment method may be any known ones, and dry and wet processes can be mentioned. In cases where the surface treatment is conducted by a dry process, the metal oxide particles are uniformly treated with a silane coupling agent by itself, or with a solution dissolving the silane coupling agent in an organic solvent, by dripping or spraying with dry air or a nitrogen gas, during stirring the particles in a mixer having a high shearing force and the like. The addition or spraying is preferably conducted at a temperature equal to or lower than the boiling point of the solvent. If the spraying is conducted at a temperature higher than the boiling point of the solvent, the solvent will evaporate before the particles are uniformly stirred, and the silane coupling agent will coagulate locally to hinder uniform surface treatment. After the addition or spraying of the silane coupling agent, the particles may be baked at a temperature of 100° C. or higher. The temperature and time for the baking treatment may be arbitrarily selected as long as intended electrophotographic properties are provided.

In a wet process, the metal oxide particles are dispersed in a solvent by stirring or employing ultrasound, a sand mill, an attritor, a ball mill, and the like, and after adding a silane coupling agent solution and stirring or dispersing the solution, the solvent is removed therefrom to obtain the uniformly treated particles. The solvent is removed by filtration or evaporation. After the removal of the solvent, the particles may be baked at a temperature of 100° C. or higher. The temperature and time for the baking treatment may be arbitrarily determined as long as intended electrophotographic properties are provided. In the wet process, moisture contained in the metal oxide particles may be removed before the addition of the surface treatment agent. The moisture can be removed by, for example, heating and stirring the solvent for surface treatment containing the particles, or performing azeotropic distillation with the solvent.

The amount of the silane coupling agent with respect to the amount of the metal oxide particles in the subbing layer 2 may be arbitrarily selected as long as intended electrophotographic properties are provided.

The subbing layer 2 preferably contains an acceptor compound (electron accepting compound) having a group that can react with the metal oxide particles, by mixing or dispersing therein, together with the aforementioned metal oxide particles. When the acceptor compound is contained in the subbing layer 2 via the metal oxide particles, electric charges can be efficiently transferred between the conductive substrate 1 and the charge generating layer 31 through the subbing layer 2, and the photoreceptor can be used over a long period of time even in the case of high-quality and high-speed image formation.

The acceptor compound may be arbitrarily selected as long as it has a group that can react with the metal oxide particles that provide intended properties. Preferable examples of the acceptor compound include the organic pigments described in Japanese Patent Application Laid-Open (JP-A) No. 47-30330, such as perylene pigments, bisbenzimidazole perylene pigments, polycyclic quinone pigments, indigo pigments, and quinacridone pigments; and pigments having an electron-withdrawing substituent such as a cyano group, a nitro group, a nitroso group, or a halogen atom, such as bisazo pigments and phthalocyanine pigments. Among these pigments, perylene pigments, bisbenzimidazole perylene pigments, and polycyclic quinone pigments are preferable from the viewpoint of high electron acceptability, and polycyclic quinone pigments are particularly preferable from the viewpoint of more effective prevention of ghosting. These pigments may be subjected to a surface treatment with a coupling agent, a binder or the like, for the purpose of controlling dispersibility and charge acceptability.

The content of the acceptor compound may be arbitrarily selected as long as intended properties are provided, but is preferably 0.01% by weight or more and 20% by weight or less, and is more preferably 0.05% by weight or more and 10% by weight or less, with respect to the amount of the metal oxide particles. If the above content is less than 0.01% by weight, sufficient acceptability that contributes to improve the charge accumulation may not be provided to the subbing layer 2, thereby easily causing deterioration in maintainability such as increase in residual potential during repeated use. If the above content is more than 20% by weight, metal oxide particles tend to aggregate, thereby failing to form a favorable conductive path within the subbing layer 2 during formation of the subbing layer 2, and as a result, image defects such as black dots tend to occur during repeated use, as well as deterioration in maintainability such as increase in residual potential.

The addition amount of the acceptor compound may be arbitrarily selected as long as intended properties are provided, but is preferably 0.01% by weight or more and 20% by weight or less, and is more preferably 0.05% by weight or more and 10% by weight or less, with respect to the amount of the metal oxide particles. If the addition amount of the acceptor compound is less than 0.01% by weight, sufficient acceptability that contributes to reduce the charge accumulation cannot be provided within the subbing layer 2, thereby easily causing deterioration in maintainability such as increase in residual potential during repeated use.

If the addition amount is more than 20% by weight, the metal oxide particles tend to cause aggregation, and cannot form a favorable conductive path within the subbing layer 2 during formation of the subbing layer 2. As a result of this, deterioration of maintainability such as increase in the residual potential may be easily caused and image defects such as black dots tend to occur during repeated use.

The acceptor compound is added to the metal oxide particles by, for example, dripping or spraying with dry air or a nitrogen gas onto the particles while stirring the perticles in, for example, a mixer having a high shearing force, thereby uniformly adding the acceptor compound to the particles. The addition or spraying of the acceptor compound is preferably conducted at a temperature of not more than the boiling point of the solvent. If the spraying is conducted at a temperature higher than the boiling point of the solvent, the solvent will evaporate before the particles are uniformly stirred, whereby the acceptor compound will coagulate locally to hinder uniform surface treatment. After the addition or spraying operation, the particles may be dried at a temperature higher than the boiling point of the solvent.

Alternatively, the metal oxide particles may be dispersed in an organic solvent by means of, for example, stirring, ultrasound, or a device such as a sand mill, an attritor or a ball mill, and then an organic solvent solution containing the acceptor compound is added therein, and refluxed, or stirred or dispersed at a temperature of not more than the boiling point of the organic solvent. The solvent is then removed, and the particles are uniformly added with the acceptor compound. The solvent may be removed by filtration, evaporation, or drying under heating.

The organic solvent may be arbitrarily selected as long as it dissolves a resin and does not cause gelation or aggregation during mixing or dispersing the inorganic metal compound and acceptor compound. Examples of such an organic solvent include ordinary organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in combination of two or more of them.

The subbing layer 2 is formed by applying a subbing layer forming coating solution, which contains the above-described metal oxide particles and additives, and the below-described curable resin, curing agent, additives, solvent, and the like, onto the conductive substrate 1 to give a layer having the above-described thickness, and then curing the coating.

The ratio between the metal oxide particles and the curable resin in the subbing layer forming coating solution may be arbitrarily selected as long as the intended properties of the photoreceptor 12 can be provided. From the viewpoint of reducing damages to the subbing layer 2 from irradiation with light, the volume ratio of the metal oxide particles to the binder resin (metal oxide particles/curable resin) is preferably in the range of 10/90 to 90/10, and more preferably in the range of 15/85 to 60/40.

The subbing layer forming coating solution may contain various additives for improvement in electrical properties, environmental stability, and image quality. Examples of the additives include known materials such as: quinone compounds such as chloranil and bromoanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; electron transporting substances such as diphenoquinone compounds such as 3,3',5,5'-tetra-t-butyldiphenoquinone; polycyclic condensed or azo electron transporting pigments; zirconium chelate compounds; titanium chelate compounds; aluminum chelate compounds; titanium alkoxide compounds; organic titanium compounds; and silane coupling agents.

The silane coupling agent may be used for surface treatment of zinc oxide, and may be contained in the coating solution as an additive. Specific examples of the silane coupling agent include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chlorpropyltrimethoxysilane. Examples of the zirconium chelate compound include zirconium butoxide, zirconium ethyl acetoacetate, zirconium triethanolamine, acetyl acetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetranormalbutyl titanate, butyl titanate dimer, tetra(2-ethylhexyl) titanate, titanium acetyl acetonate, polytitanium acetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compound include aluminum isopropylate, monobutoxy aluminum diisopropylate, aluminum butylate, diethylacetoacetate aluminum diisopropylate, and aluminum tris(ethylacetoacetate). These compounds may be used alone, or as a mixture or a polycondensate of them.

The subbing layer forming coating solution preferably contains resin particles as an additive. The resin particles may be used for preventing light reflection on the conductive support. The resin particles contained in the subbing layer forming coating solution preferably have an average particle diameter of 1.0 μm or more. Specific examples of the resin particles include silicon resin particles and fluorine resin particles. When the subbing layer is formed using the subbing layer forming coating solution containing the resin particles, wood grain density variations, which are caused by interference light that may occur within the photoreceptor when a coherent light source such as a laser beam is used as the exposure light for image formation, can be suppressed. From the viewpoint of achieving the suppression effect more sufficiently, the average diameter of the resin particles is preferably 0.05 μm or more and 5.0 μm or less.

The curable resin serves as a binder resin in the subbing layer when cured in the presence of a curing agent. The curable resin (binder resin) may be any conventional binder resin used for a subbing layer, and may be used together with a silane coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethyl aminopropyltrimethoxysilane, γ-mercaptopropyltrimethoxysilane, γ-ureidopropyltriethoxysilane, or β-3,4-epoxycyclohexyltrimethoxysilane. The binder resin may be any known binder resin used for a subbing layer, and examples of the binder resin include polyvinyl alcohol, polyvinylmethyl ether, poly-N-vinylimidazole, polyethylenoxide, ethyl cellulose, methyl cellulose, ethylene-acrylic acid copolymers, polyamides, polyimides, casein, gelatin, polyethylene, polyester, phenolic resins, vinyl chloride-vinyl acetate copolymers, epoxy resins, polyvinylpyrrolidone, polyvinylpyridine, polyurethane, polyglutamic acid, and polyacrylic acid.

The curing agent is not particularly limited as long as it can cure the curable resin to give a binder resin, but is particularly preferably an isocyanate. The isocyanate is, among those obtained by reacting a polyisocyanate compound with an active hydrogen-containing compound serving as a blocking agent, preferably one that is stable at normal temperature (from 15° C. to 25° C.) and regenerates an isocyanate group through dissociation of the blocking agent when heated in predetermined conditions (for example, 50° C. or higher and 200° C. or lower).

Examples of the polyisocyanate compound include, tolylene diisocyanate, diphenylmethane-4,4'-diisocyanate, hexamethylene diisocyanate, isophorone diisocyanate, dicyclohexylmethane diisocyanate, and polymethylene polyphenyl polyisocyanate.

Examples of the blocking agent include: lactams such as caprolactam; oximes such as methyl ethyl ketoxime and acetoxime; and β-diketones such as diethyl malonate and diethyl acetoacetate.

The solvent for preparing the subbing layer forming coating solution may be arbitrarily selected from known organic solvents such as alcohols, aromatics, hydrocarbon halides, ketones, ketone alcohols, ethers, and esters. Examples of the organic solvent include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

The solvent used for dispersing may be used alone or in combination of two or more of them. The mixed solvent may be arbitrarily selected as long as it can dissolve the curable resin (binder resin).

The metal oxide particles are dispersed by any known means such as a roll mill, a ball mill, a vibration ball mill, an attritor, a sand mill, a colloid mill, or a paint shaker.

The method for applying the subbing layer forming coating solution to form the subbing layer 2 may be any common method such as blade coating, wire bar coating, spray coating, dip coating, bead coating, air knife coating, or curtain coating.

The subbing layer 2 formed on the conductive substrate preferably has a Vickers hardness of 35 or more.

As discussed above, the volume resistance value of the subbing layer 2, when included in the photoreceptor 12 and mounted on the image forming apparatus 10, is regulated to decrease from the one end portion closer to the charge removing light source 28A toward the other end portion in the rotation axis direction Y. On the other hand, the volume resistivity of the subbing layer 2, when included in the photoreceptor 12 and mounted on the image forming apparatus 10, is constant or substantially constant in the rotation axis direction Y.

The volume resistivity of the subbing layer 2 is preferably in the range of from $10^8$ Ω·cm to $10^{15}$ Ω·cm, or from about $10^8$ Ω·cm to about $10^{15}$ Ω·cm, and more preferably in the range of from $10^{10}$ Ω·cm to $10^{13}$ Ω·cm, or from about $10^{10}$ Ω·cm to about $10^{13}$ Ω·cm. If the volume resistivity is less than $10^8$ Ω·cm or less than about $10^8$ Ω·cm, the charging potential may not be sufficient or a leak may occur. On the other hand, if the volume resistivity is more than $10^{15}$ Ω·cm or more than about $10^{15}$ Ω·cm, residual potential within the subbing layer 2 may increase to hinder the achievement of stable potential characteristics during repeated use.

The volume resistivity of the subbing layer 2 can be regulated to fall within the above range by, for example, controlling the preparation conditions for formation of the subbing layer forming coating solution.

More specifically, for example, when preparing the subbing layer forming coating solution, mixing conditions for the metal oxide particles are regulated so that the intended volume resistivity within the above range may be obtained. The mixing conditions may vary depending on, for example, the mixing device or the composition of the mixed solution. For example, in cases where the particles are mixed using a sand mill, the subbing layer 2 can be prepared so as to have the volume resistivity within the above range in such conditions that the filling rate of glass beads is 60% by volume or more and 80% by volume or less, the flow rate is 1000 ml/minute or more and 2500 ml/minute or less, and the mixing time is 0.5 hours or more, preferably 0.8 hours or more and 1.5 hours or less. By satisfying the mixing conditions as above, the state of dispersion of the metal oxide particles in the subbing layer 2 can be regulated, thereby achieving the intended volume resistivity of the resulting subbing layer 2. In order to control the above mixing conditions to give the volume resistivity within the above range more reliably, for example, mixing time is preferably determined by sampling the undercoat layer forming coating solution at established intervals and measuring the volume resistivity of a coating film obtained from each sample solution to examine whether the volume resistivity of the coating film has reached the intended range, during mixing.

Consequently, the volume resistivity can be used as an index for the dispersion state of the metal oxide particles in the subbing layer 2.

When the subbing layer has a volume resistivity within the above range, in the formation of the subbing layer 2 showing the volume resistivity in the above range, an index of the dispersing state of the metal oxide particles may also be obtained by applying the undercoat layer forming coating solution for the subbing layer 2 onto a plate such as a glass plate to give a coating having a thickness of 20 μm (when cured); drying the coating to remove the solvent and curing to form a coating film; and measuring the light transmittance of the coating film at a wavelength of 950 nm by a spectrophotometer.

The wavelength of 950 nm of the light used for measuring the above light transmittance corresponds to the wavelength of light absorbed by the metal oxide particles. Therefore, the result of measurement of light transmittance of the coating film may also be used as the index of formation state of charge conduction paths by the metal oxide particles, as well as the dispersion state of the metal oxide particles contained in the subbing layer 2 and the volume resistivity of the subbing layer 2.

In order to prevent occurrence of a moire image, the surface roughness of the subbing layer 2 is regulated to be ¼n (n is a refractive index of the upper layer) or more and ½n or less of the laser wavelength λ used for exposure. In order to regulate the surface roughness of the subbing layer, particles such as resin particles may be added in the subbing layer. Examples of the resin particles include silicone resin particles, and cross-linked PMMA resin particles, and the like. In order to regulate the surface roughness, the subbing layer may be subjected to polishing. The method for polishing may be, for example, buff polishing, sandblasting, wet honing, or grinding.

An intermediate layer (not shown) may be provided between the subbing layer 2 and the photosensitive layer 3 for the purpose of, for example, improving electrical properties, image quality, image quality maintainability, and adhesiveness to the photosensitive layer. The intermediate layer may be composed of a polymer resin compound and an organic metal compound. Examples of the polymer resin compound include acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins. Examples of the organic metal compound include those containing zirconium, titanium, aluminum, manganese, silicon and the like. These compounds may be used alone, or as a mixture or a polycondensate of them. Among these, organic metal compounds containing zirconium or silicon provide excellent performances, since they show a low residual potential, little change in potential due to the environment, and little change in potential during repeated use.

Examples of the silicon compound include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Among them, particularly preferable silicon compounds include silane coupling agents such as vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl) 3-aminopropyltrimethoxysilane, N-2-(aminoethyl)3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane.

Examples of the organic zirconium compound include zirconium butoxide, zirconium ethyl acetoacetate, zirconium triethanolamine, acetyl acetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the organic titanium compound include tetraisopropyl titanate, tetranormalbutyl titanate, butyl titanate dimer, tetra(2-ethylhexyl)titanate, titanium acetyl acetonate, polytitanium acetyl acetonate, titanium octylene glycolate, titanium lactate ammonium salt, titanium lactate, titanium lactate ethyl ester, titanium triethanol aminate, and polyhydroxy titanium stearate.

Examples of the organic aluminum compound include aluminum isopropylate, monobutoxy aluminum diisopropylate, aluminum butylate, diethylacetoacetate aluminum diisopropylate, and aluminum tris(ethylacetoacetate).

The intermediate layer also serves as an electrical blocking layer, as well as improving coating properties of the upper layer. However, if the layer is too thick, the electrical barrier may become too strong, thereby causing desensitization or increase in potential during repeated use. Accordingly, the thickness of the intermediate layer is set in the range of 0.1 μm or more and 5 μm or less.

(Photosensitive Layer)

The photosensitive layer 3 includes a charge generating layer 31 and a charge transporting layer 32 laminated on the charge generating layer 31. A protective layer (not shown) may be further laminated on the charge transporting layer 32.

The charge generating layer 31 is formed by performing vacuum deposition of a charge generating substance, or applying a dispersion containing a charge generating substance. In cases where the charge generating layer is formed by applying the dispersion, the charge generating layer 31 is formed by applying a dispersion containing a charge generating substance dispersed therein together with an organic solvent, a binder resin, additives and the like.

The charge generating material is preferably a metal phthalocyanine pigment, and gallium phthalocyanines having a specific crystal as described below are particularly preferable. Chlorogallium phthalocyanine used in this exemplary embodiment is produced by any known method such as those disclosed in, for example, JP-A Nos. 5-263007 and 5-279591.

The binder resin used in the charge generating layer 31 may be selected from a wide range of insulating resins or organic photoconductive polymers such as poly-N-vinylcarbazole, polyvinyl anthracene, polyvinyl pyrene, and polysilane. Preferable examples of the binder resin include, but are not limited to, insulating resins such as polyvinyl acetal resins, polyarylate resins (for example, a polycondensate of bisphenol A with phthalic acid), polycarbonate resins, polyester resins, phenoxy resins, vinyl chloride-vinyl acetate copolymers, polyamide resins, acrylic resins, polyacrylamide resins, polyvinylpyridine resins, cellulose resins, urethane resins, epoxy resins, casein, polyvinyl alcohol resins, and polyvinyl pyrrolidone resins. These binder resins may be used alone or in combination of two or more of them. Among them, polyvinyl acetal resins are particularly preferable.

In the charge generating layer forming coating solution, the mixing ratio (weight ratio) between the charge generating substance and the binder resin is preferably in the range of from 10:1 to 1:10. The solvent for preparing the coating solution may be arbitrarily selected from known organic solvents such as alcohols, aromatics, halogenated hydrocarbons, ketones, ketone alcohols, ethers, and esters. Examples of the organic solvent include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

The solvent for dispersion is used alone or in combination of two or more of them. The mixed solvent may be arbitrarily selected as long as it can dissolve the binder resin as a mixed solvent.

The means for dispersing may be any ordinary one such as a roll mill, a ball mill, a vibration ball mill, an attritor, a sand mill, a colloid mill, or a paint shaker. The application method for forming the charge generating layer may be any common method such as blade coating, wire bar coating, spray coating, dip coating, bead coating, air knife coating, or curtain coating.

The particles to be dispersed in the above process preferably have a particle size of 0.5 μm or less, more preferably 0.3 μm or less, and further preferably 0.15 μm or less, for achieving high sensitivity and high stability.

The charge generating material may be subjected to a surface treatment for the purposes of improving electrical properties, preventing image defects and the like. Providing a surface treatment may improve dispersibility of the charge generating material and coating properties of the charge generating layer forming coating solution, whereby the charge generating layer 31 having high levels of smoothness and dispersion uniformity can be readily and reliably formed. As a result, occurrence of image defects such as fogging or ghosting can be suppressed, and image quality maintainability can be improved. In addition, storage stability of the charge generating layer forming coating solution can be significantly improved to effectively extend the pot life, thereby realizing cost reduction in producing the photoreceptor.

The surface treatment agent may be an organic metal compound or a silane coupling agent having a hydrolysable group.

The organic metal compound or a silane coupling agent having a hydrolysable group is preferably a compound expressed by the formula (A): Rp-M-Yq (wherein R represents an organic group, M represents an atom of a metal other than alkali metals or a silicon atom, Y represents a hydrolysable group, p and q are each independently an integral number of 1 to 4, and the sum of p and q is equivalent to the valence of M).

In formula (A), examples of the organic group expressed by R include: alkyl groups such as a methyl group, an ethyl group, a propyl group, a butyl group, and an octyl group; alkenyl groups such as a vinyl group and an allyl group; cycloalkyl groups such as a cyclohexyl group; aryl groups such as a phenyl group and a naphthyl group; alkaryl groups such as a tolyl group; arylalkyl groups such as a benzyl group and a phenylethyl group; arylalkenyl groups such as a styryl group; and heterocyclic residues such as a furyl group, a thienyl group, a pyrrolidinyl group, a pyridyl group, and an imidazolyl group. These organic groups may have one or more kinds of substituent.

In formula (A), examples of the hydrolysable group expressed by Y include: ether groups such as a methoxy group, an ethoxy group, a propoxy group, a butoxy group, a cyclohexyloxy group, a phenoxy group, and a benzyloxy group; ester groups such as an acetoxy group, a propionyloxy group, an acryloxy group, a methacryloxy group, a benzoyloxy group, a methanesulfonyloxy group, a benzenesulfonyloxy group, and a benzyloxycarbonyl group; and halogen atoms such as a chlorine atom.

In formula (A), M is not particularly limited as long as it is not an alkali metal, but is preferably a titanium atom, an aluminum atom, a zirconium atom, or a silicon atom. More specifically, in the invention, an organic titanium compound, an organic aluminum compound, an organic zirconium compound, and a silane coupling agent substituted by the organic group or hydrolysable functional group as mentioned above are favorably used.

Examples of the silane coupling agent include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyl triethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Among them, vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)-3-aminopropyltrimethoxysilane, N-2-(aminoethyl)-3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane are more preferable.

Organic zirconium compounds as follows may also be used: zirconium butoxide, zirconium ethyl acetoacetate, zirconium triethanolamine, acetyl acetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, or isostearate zirconium butoxide.

Organic titanium compounds as follows may also be used: tetraisopropyl titanate, tetranormalbutyl titanate, butyl titanate dimer, tetra(2-ethylhexyl)titanate, titanium acetyl acetonate, polytitanium acetyl acetonate, titanium octylene glycolate, titanium lactate ammonium salt, titanium lactate, titanium lactate ethyl ester, titanium triethanol aminate, and polyhydroxy titanium stearate. Organic aluminum compound as follows may also be used: aluminum isopropylate, monobutoxy aluminum diisopropylate, aluminum butylate, diethylacetoacetate aluminum diisopropylate, and aluminum tris(ethylacetoacetate).

Hydrolysis products obtained from the aforementioned organic metal compounds and silane coupling agents are also useful. Examples of the hydrolysis product include those obtained by hydrolysis of the group Y (hydrolysable group) linked to the group M (a metal atom or a silicon atom other than alkali metals) or a hydrolysable group substituting the group R (organic group), in the organic metal compound expressed by formula (A). In cases where the organic metal compound or silane coupling agent has two or more hydrolysable groups, it is not necessary that all of them are hydrolyzed. These organic metal compounds and silane coupling agents may be used alone or in combination of two or more.

Examples of the method for coating a phthalocyanine pigment with the organic metal compound and/or silane coupling agent having a hydrolysable group (hereinafter collectively referred to as "organic metal compound") include a method of coating a phthalocyanine pigment during regulation of the crystals of the phthalocyanine pigment; a method of coating a phthalocyanine pigment before dispersing the pigment in a binder resin; a method of mixing an organic metal compound with a phthalocyanine pigment during dispersing the pigment in a binder resin; and a method of dispersing a phthalocyanine pigment in a binder resin, and then dispersing an organic metal compound therein.

More specifically, examples of the method of previously coating a phthalocyanine pigment during regulating the crystal of the pigment include a method of heating the mixture of an organic metal compound and a phthalocyanine pigment before the crystal is regulated; a method of mixing an organic metal compound with a phthalocyanine pigment before the crystal is regulated, and then mechanically milling the mixture by a dry process; and a method of mixing an organic metal compound and water or a mixture of water and an organic solvent with a phthalocyanine pigment before the crystal is regulated, and then milling the mixture by a wet process.

Examples of the method of coating a phthalocyanine pigment before being dispersed in a binder resin include a method of heating the mixture of an organic metal compound, water or a mixture of water and an organic solvent, and a phthalocyanine pigment; a method of directly spraying an organic metal compound onto a phthalocyanine pigment; and a method of mixing an organic metal compound with a phthalocyanine pigment, and then milling the mixture.

Examples of the method of mixing an organic metal compound with a phthalocyanine pigment during dispersion of the pigment in a binder resin include a method of adding an organic metal compound, a phthalocyanine pigment, and a binder resin to the dispersion solvent, in this order while mixing; and a method of adding these components at the same time and mixing.

The charge generating layer forming coating solution may contain various additives for the purposes of improving electrical properties and image quality. Examples of the additives include known materials such as: quinone compounds such as chloranil, bromoanil and anthraquinone; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; electron transporting substances such as diphenoquinone compounds such as 3,3',5,5'-tetra-t-butyldiphenoquinone; polycyclic condensed or azo electron transporting pigments; zirconium chelate compounds; titanium chelate compounds; aluminum chelate compounds; titanium alkoxide compounds; organic titanium compounds; and silane coupling agents.

Examples of the silane coupling agent include vinyltrimethoxysilane, γ-methacryloxypropyl-tris(β-methoxyethoxy)silane, β-(3,4-epoxycyclohexyl)ethyltrimethoxysilane, γ-glycidoxypropyl trimethoxysilane, vinyltriacetoxysilane, γ-mercaptopropyl trimethoxysilane, γ-aminopropyl triethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane.

Examples of the zirconium chelate compound include zirconium butoxide, zirconium ethyl acetoacetate, zirconium triethanolamine, acetyl acetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetranormalbutyl titanate, butyl titanate dimer, tetra(2-ethylhexyl)titanate, titanium acetyl acetonate, polytitanium acetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compound include aluminum isopropylate, monobutoxy aluminum diisopropylate, aluminum butylate, diethylacetoacetate aluminum diisopropylate, and aluminum tris(ethylacetoacetate).

These compounds may be used alone, or as a mixture or a polycondensate of two or more of them.

The application method for forming the charge generating layer 31 may be any common method such as blade coating, wire bar coating, spray coating, dip coating, bead coating, air knife coating, or curtain coating.

The coating solution may contain a slight amount of silicone oil as a leveling agent for improving smoothness of the coating film. The thickness of the charge generating layer 31 is preferably 0.1 μm or more and 5 μm or less, and more preferably 0.2 μm or more and 2.0 μm or less.

The charge transporting layer 32 may be formed by any known technique. The charge transporting layer contains a charge transporting material and a binder resin, or a charge transporting polymer.

Examples of the charge transporting substance that may be contained in the charge transporting layer 32 include, but are not limited to, electron transporting compounds such as: quinone compounds such as p-benzoquinone, chloranil, bromanil, and anthraquinone; fluorenone compounds such as tetracyanoquinodimethane compound and 2,4,7-trinitrofluorenone; xanthone compounds; benzophenone compounds; cyanovinyl compounds; and ethylene compounds, and electron hole transporting compounds such as: triarylamine compounds, benzidine compounds, arylalkane compounds, aryl-substituted ethylene compounds, stilbene compounds, anthracene compounds, and hydrazone compounds. The charge transporting substance may be used alone or in combination of two or more of them, but is preferably those expressed by the formulae (B-1) to (B-3) from the viewpoint of mobility.

(B-1)

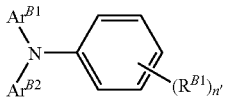

In the formula (B-1), $R^{B1}$ represents a methyl group; n' represents an integral number of 0 to 2; $Ar^{B1}$ and $Ar^{B2}$ each independently represent a substituted or unsubstituted aryl group, wherein the substituent is a halogen atom, an alkyl group having 1 to 5 carbon atoms, an alkoxy group having 1 to 5 carbon atoms, or an amino group substituted by an alkyl group having 1 to 3 carbon atoms.

(B-2)

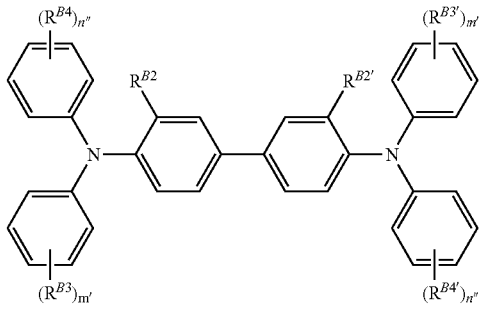

In the formula (B-2), $R^{B2}$ and $R^{B2'}$ may be the same or different from each other, and each represent a hydrogen atom, a halogen atom, an alkyl group having 1 to 5 carbon atoms, or an alkoxy group having 1 to 5 carbon atoms; $R^{B3}$, $R^{B3'}$, $R^{B4}$, and $R^{B4}$ may be the same or different from each other, and each represent a hydrogen atom, a halogen atom, an alkyl group having 1 to 5 carbon atoms, an alkoxy group having 1 to 5 carbon atoms, an amino group substituted by an alkyl group having 1 to 2 carbon atoms, a substituted or unsubstituted aryl group, or —C($R^{B5}$)═C($R^{B6}$)($R^{B7}$), wherein $R^{B5}$, $R^{B6}$, and $R^{B7}$ each independently represent a hydrogen atom, a substituted or unsubstituted alkyl group, or a substituted or unsubstituted aryl group; and m' and n" each independently represent an integral number from 0 to 2.

resin include, but are not limited to: insulating resins such as polycarbonate resins, polyester resins, polyarylate resins, methacrylic resins, acrylic resins, polyvinyl chloride resins, polyvinylidene chloride resins, polystyrene resins, acrylonitrile-styrene copolymers, acrylonitrile-butadiene copolymers, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-carbazole, polyvinyl butyral, polyvinyl formal, polysulfone, casein, gelatin, polyvinyl alcohol, ethyl cellulose, phenolic resins, polyamide, polyacrylamide, carboxy-methyl cellulose, vinylidene chloride polymer wax, and polyurethane; and organic photoconductive polymers such as polyvinyl carbazole, polyvinyl anthracene, polyvinyl pyrene, polysilane, and charge transporting polyester polymers described in JP-A Nos. 8-176293 and 8-208820. These binder resins may be used alone or in combination of two or more of them. In particular, polycarbonate resins, polyester resins, methacrylic resins, and acrylic resins are preferable because they provide excellent compatibility with charge transporting materials, solubility in solvents, and strength. The mixing ratio (weight ratio) between the charge transporting substance and the binder resin is preferably in the range of from 10:1 to 1:5.

The organic photoconductive polymer may be used alone. The organic photoconductive polymer may be any known one that has charge transporting properties, such as poly-N-vinyl carbazole and polysilane. In particular, the polyester polymer charge transporting material described in JP-A Nos.

(B-3)

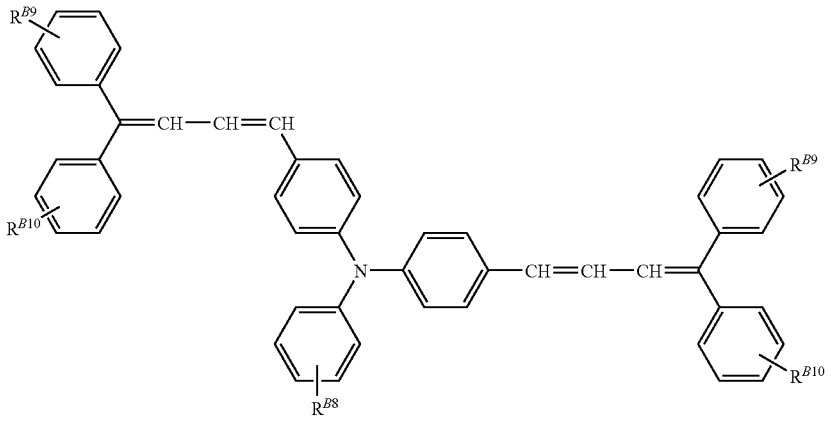

In the formula (B-3), $R^{B8}$ represents a hydrogen atom, an alkyl group having 1 to 5 carbon atoms, an alkoxy group having 1 to 5 carbon atoms, a substituted or unsubstituted aryl group, or —CH═CH—CH═C($Ar^{B3}$)$_2$, wherein $Ar^{B3}$ represents a substituted or unsubstituted aryl group; $R^{B9}$ and $R^{B10}$ may be the same or different from each other, and each represent a hydrogen atom, a halogen atom, an alkyl group having 1 to 5 carbon atoms, an alkoxy group having 1 to 5 carbon atoms, an amino group substituted by an alkyl group having 1 to 2 carbon atoms, or a substituted or unsubstituted aryl group.

The binder resin in the charge transporting layer 32 may be arbitrarily selected from any known ones, but is preferably a resin that can form an insulating film. Examples of the binder 8-176293 and 8-208820 are preferable because of their excellent charge transporting properties. The polymer charge transporting material may be used to form the charge transporting layer 32 by itself, or may be mixed with the aforementioned binder resin.

In cases where the charge transporting layer 32 is positioned as the surface layer (the layer positioned farthest from the conductive substrate of the photosensitive layer) of the electrophotographic photoreceptor, the charge transporting layer 32 preferably contains particles that provide lubricity (for example, silica particles, alumina particles, fluorine resin particles such as polytetrafluoroethylene (PTFE), and silicone resin particles) in order to make the surface more resistant to abrasion or scratches and improve cleaning properties to remove a developer attached to the photoreceptor surface. These lubricity imparting particles may be used in combination of two or more kinds of them, and fluorine resin particles are particularly preferable.

The fluorine resin particles are preferably one or more of those made of a resin selected from an ethylene tetrafluoride resin, an ethylene chloride trifluoride resin, a propylene hexafluoride resin, a vinyl fluoride resin, a vinylidene fluoride resin, an ethylene dichloride difluoride resin, and copolymers thereof, and particularly preferably an ethylene tetrafluoride resin and a vinylidene fluoride resin.

The primary particle diameter of the fluorine resin particles is preferably 0.05 μm or more and 1 μm or less, and more preferably 0.1 μm or more and 0.5 μm or less. If the primary particle diameter of the fluorine resin particles is less than 0.05 μm, the particles tend to cause aggregation during or after dispersion. On the other hand, if the primary particle diameter of the fluorine resin particles is more than 1 μm, the incidence of image defects may increase.

The content of the fluorine resin in the charge transporting layer is preferably 0.1% by weight or more and 40% by weight or less, and particularly preferably 1% by weight or more and 30% by weight or less with respect to the whole amount of the charge transporting layer. If the above content is less than 1% by weight, modification effect through the dispersion of the fluorine resin particles may not be sufficient. On the other hand, if the above content is more than 40% by weight, light permeability may decrease and the residual potential during repeated use may increase.

The charge transporting layer 32 may be formed by applying a charge transporting layer forming coating solution obtained by dissolving a charge transporting substance, a binder resin, and other materials in an appropriate solvent, and then drying.

Examples of the solvent used for forming the charge transporting layer 32 include: aromatic hydrocarbon solvents such as toluene and chlorobenzene; aliphatic alcohol solvents such as methanol, ethanol, and n-butanol; ketone solvents such as acetone, cyclohexanone, and 2-butanone; aliphatic halogenated hydrocarbon solvents such as methylene chloride, chloroform, and ethylene chloride; cyclic or linear ether solvents such as tetrahydrofuran, dioxane, ethylene glycol, and diethyl ether; and mixtures of these solvents. The mixing ratio (weight ratio) between the charge transporting substance and the binder resin is preferably in the range of from 10:1 to 1:5.

The charge transporting layer forming coating solution may contain a leveling agent such as silicone oil for improving smoothness of the coating film.

Examples of the means for dispersing the fluorine resin into the charge transporting layer 32 include a roll mill, a ball mill, a vibration ball mill, an attritor, a sand mill, a high pressure homogenizer, an ultrasonic disperser, a colloid mill, a collision type medialess disperser, or a penetration type medialess disperser.

The fluorine resin may be dispersed into the coating solution for forming the charge transporting layer 32 by, for example, dispersing the fluorine resin particles into a solution containing a binder resin and a charge transporting material dissolved in a solvent.

In the process of preparing the coating solution for forming the charge transporting layer 32, the temperature of the coating solution is preferably controlled within the range of 0° C. or more and 50° C. or less.

Examples of the method for controlling the temperature of the coating solution in the process of preparing the coating solution to be in the range of 0° C. or more and 50° C. or less include: cooling the solution with water, air, or a cooling medium; controlling the room temperature (usually from 15° C. to 25° C.) during the preparation process; warming the solution with hot water, hot air, or a heater; and constructing the equipment for producing the coating solution with a material that is less heat generating, a material having a high heat reserving property, or a material having a high heat reserving property. It is also effective that the coating solution contains a small amount of dispersion aid for improving dispersion stability of the dispersion liquid and preventing aggregation thereof during formation of the coating film. Examples of the dispersion aid include fluorine surfactants, fluorine polymers, silicone polymers, and silicone oil.

It is also an effective method that the fluorine resin and the dispersion aid are dispersed in a small amount of a solvent, stirred and mixed in advance, then the resultant is mixed with a solution dissolving a charge transporting material, a binder resin, and a dispersion solvent under stirring, and thereafter dispersed according to the aforementioned method.

Examples of the application method for forming the charge transporting layer 32 include dip coating, extrusion coating, spray coating, roll coater coating, wire bar coating, gravure coating, bead coating, curtain coating, blade coating, and air knife coating.

The thickness of the charge transporting layer 32 is preferably 5 μm or more and 50 μm or less, and more preferably 10 μm or more and 40 μm or less.

The photoreceptor 12 may further contain other additives such as an antioxidant and a light stabilizer in the photosensitive layer 3 for the purpose of preventing deterioration of the photoreceptor 12 caused by ozone or an oxidizing gas generated in the electrophotographic apparatus, light, or heat.

Examples of the antioxidant include hindered phenol, hindered amine, paraphenylenediamine, aryl alkane, hydroquinone, spirochromane, spiroindanone, derivatives thereof, organic sulfur compounds, and organic phosphorus compounds.

Specific examples of the phenol-based antioxidant include 2,6-di-t-butyl-4-methyl phenol, styrenated phenol, n-octadecyl-3-(3',5'-di-t-butyl-4-hydroxyphenyl)propionate, 7,2'-methylene-bis-(4-methyl-6-t-butylphenol), 2-t-butyl-6-(3-t-butyl-5'-methyl-2'-hydroxybenzyl)-4-methylphenyl acrylate, 4,4'-butylidene-bis-(3-methyl-6-t-butylphenol), 4,4'-thio-bis-(3-methyl-6-t-butylphenol), 1,3,5-tris(4-t-butyl-3-hydroxy-2,6-dimethylbenzyl)isocyanurate, tetrakis[methylene-3-(3',5-di-t-butyl-4-hydroxyphenyl)propionate] methane, and 3,9-bis[2-[3-(3-t-butyl-4-hydroxy-5-methylphenyl)propionyloxy]-1,1-dimethylethyl]-2,4,8,10-tetraoxaspiro[5.5]undecane.

Specific examples of the hindered amine-based antioxidant include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxy phenyl)propionyloxy]-2,2,6,6-tetramethylpiperidine, 8-benzyl-7,7,9,9-tetramethyl-3-octyl-1,3,8-triazaspiro[4.5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl)imino-1,3,5-triazine-2,4-diimyl}{(2,2,6,6-tetramethyl-4-piperidyl) imino}hexamethylene{(2,3,6,6,-tetramethyl-4-piperidyl) imino}], 2-(3,5-di-t-butyl-4-hydroxybenzyl)-2-n-butyl malonate bis(1,2,2,6,6-pentamethyl-4-piperidyl), and N,N'-bis(3-aminopropyl)ethylenediamine-2,4-bis[N-butyl-N-(1,2,2,6,6-pentamethyl-4-piperidyl)amino]-6-chloro-1,3,5-triazine condensate.

Examples of the organic sulfur-based antioxidant include dilauryl-3,3'-thiodipropionate, dimyristyl-3,3-thiodipropionate, distearyl-3,3-thiodipropionate, pentaerythritol-tetrakis-(β-lauryl-thiopropionate), ditridecyl-3,3'-thiodipropionate, and 2-mercaptobenzimidazole.

Examples of the organic phosphorus-based antioxidant include trisnonylphenyl phosphite, triphenyl phosphite, and tris(2,4-di-t-butylphenyl)-phosphite.

The organic sulfur-based and organic phosphorus-based antioxidants are called secondary antioxidants, which generate a synergistic effect when used in combination with a primary antioxidant such as phenolic or amine-based one.

Examples of the light stabilizer include derivatives of benzophenone, benzotriazole, dithiocarbamate, and tetramethylpiperidine.

Examples of the benzophenone-based light stabilizer include 2-hydroxy-4-methoxybenzophenone, 2-hydroxy-4-octoxybenzophenone, and 2,2'-di-hydroxy-4-methoxybenzophenone. Examples of the benzotriazole-based light stabilizer include 2-(2'-hydroxy-5'-methylphenyl)-benzotriazole, 2-[2'-hydroxy-3'-(3",4",5",6"-tetra-hydrophthalimido-methyl)-5'-methylphenyl]-benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-t-butylphenyl)-benzotriazole, 2-(2'-hydroxy-5'-t-octylphenyl)-benzotriazole, and 2-(2'-hydroxy-3,5'-di-t-amylphenyl)-benzotriazole.

Examples of other compounds include 2,4-di-t-butylphenyl-3',5'-di-t-butyl-4'-hydroxybenzoate, and nickel dibutyldithiocarbamate.

The photoreceptor 12 may further contain at least one electron accepting substance for the purposes of improving sensitivity, reducing residual potential, reducing fatigue by repeated use, and the like.

Examples of the electron accepting substance include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, m-nitrobenzoic acid, and phthalic acid. Among them, fluorenones, quinones, and benzene derivatives having an electron-withdrawing substituent such as Cl, CN, or $NO_2$ are particularly preferable.

In this exemplary embodiment, a protective layer (not shown) may be provided on the charge transporting layer 32. The protective layer prevents chemical change of the charge transporting layer 32 during charging, and improves mechanical strength of the photosensitive layer 3.

In the photoreceptor 12 having a laminated structure, the protective layer prevents chemical change of the charge transporting layer during charging, and improves mechanical strength of the photoreceptor 12, thereby improving resistance of the surface layer to abrasion or scratches.

The protective layer is composed of a binder resin (including a curable resin) and a charge transporting compound. The protective layer takes the shape of a cured resin film containing a curable resin or a charge transporting compound, a film formed from an appropriate binder resin containing a conductive material, and the like. The curable resin may be any known resin, and examples thereof include a phenolic resin, a polyurethane resin, a melamine resin, a diallyl phthalate resin, and a siloxane resin.

The charge transporting compound may be the aforementioned charge transporting substance or charge transporting resin used in the charge transporting layer 32. Examples of the conductive material include, but are not limited to, metallocene compounds such as dimethylferrocene, and metal oxides such as antimony oxide, tin oxide, titanium oxide, indium oxide, and ITO.

The electrical resistance of the protective layer is preferably $10^9$ Ω·cm or more and $10^{14}$ Ω·cm or less. If the electrical resistance is more than $10^{14}$ Ω·cm, the residual potential may increase. On the other hand, if the electrical resistance is less than $10^9$ Ω·cm, leaking of charges in a creepage surface direction may exceed a negligible level, thereby causing decrease in resolution.

The thickness of the protective layer is preferably 0.5 μm or more and 20 μm or less, and more preferably 2 μm or more and 10 μm or less. In cases where a protective layer is provided, as necessary, a blocking layer may be provided between the photosensitive layer 3 and the protective layer for preventing charge leaks from the protective layer to the photosensitive layer 3. The blocking layer may be composed of the same known material as those that may be included in the protective layer.

The protective layer may contain a fluorine atom-containing compound for the purpose of imparting surface lubricity. The improvement in surface lubricity serves to decrease the coefficient of friction against a cleaning member, thereby improving abrasion resistance. In addition, the compound can prevent adhesion of discharging products, developer or paper powder to the photoreceptor surface, and achieve longer operating life of the photoreceptor.

The fluorine-containing compound may be added as a fluorine atom-containing polymer in itself, such as polytetrafluoroethylene, or as the particles thereof. The content of the fluorine-containing compound in the protective layer is preferably 20% by weight or less. If the content is beyond this range, film formation properties of the cross-linked cured film may be adversely affected.

Although the aforementioned protective layer has sufficient oxidation resistance, the layer may contain an antioxidant for the purpose of further enhancing the oxidation resistance. The antioxidant is preferably a hindered phenol or a hindered amine, and may be a known antioxidant such as an organic sulfur antioxidant, a phosphite antioxidant, a dithiocarbamate antioxidant, a thiourea antioxidant, or a benzimidazole antioxidant. The content of the antioxidant in the protective layer is preferably 15% by weight or less, and more preferably 10% by weight or less.

Examples of the hindered phenol antioxidant include 2,6-di-t-butyl-4-methylphenol, 2,5-di-t-butylhydroquinone, N,N'-hexamethylenebis(3,5-di-t-butyl-4-hydrxyhydro-cinnamamide, 3,5-di-t-butyl-4-hydroxy-benzylphosphonate-diethylester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amyl hydroquinone, 2-t-butyl-6-(3-butyl-2-hydroxy-5-methylbenzyl)-4-methylphenylacrylate, and 4,4'-butylidenebis(3-methyl-6-t-butylphenol).

The protective layer may further contain other known additives used for formation of a coating film, such as a leveling agent, an ultraviolet absorber, a light stabilizer, and a surfactant. The protective layer is formed by applying a mixture of the above-described materials and additives onto the photosensitive layer, and heating the coating to cause three dimensional cross-linking reaction, thereby forming a strong cured film. The temperature of the heating treatment is not particularly limited as long as the underlying photosensitive layer 3 is not damaged, but is preferably from room temperature to 200° C., and particularly preferably from 100° C. to 160° C.

In the formation of the protective layer, when a cross-linking material is employed, cross-linking reaction may be accompanied with or without an appropriate catalyst. Examples of the catalyst include: acid catalysts such as hydrochloric acid, sulfuric acid, phosphoric acid, formic acid, acetic acid, and trifluoroacetic acid; bases such as ammonia and triethylamine; organic tin compounds such as dibutyltin diacetate, dibutyltin dioctoate, and tin octoate; organic titanium compounds such as tetra-n-butyl titanate and tetraisopropyl titanate; iron salts, manganese salts, cobalt salts, zinc salts, zirconium salts of organic carboxylic acid; and aluminum chelate compounds.

The protective may contain a solvent for the purpose of facilitating the application process. Specific examples of the solvent include ordinary organic solvents such as water, methanol, ethanol, n-propanol, i-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, dimethyl ether, and dibutyl ether. These solvents may be used alone or in combination of two or more of them.

In the formation of the protective layer, the application method may be any common method such as blade coating, wire bar coating, spray coating, dip coating, bead coating, air knife coating, or curtain coating.

In the photoreceptor 12 according to this exemplary embodiment, the thickness of a functional layer, which may be provided over the charge generating layer for achieving a high degree of resolution, may be arbitrarily selected as long as intended properties are obtained, but is preferably 50 μm or less. In cases where the functional layer is a thin film, a combination of the subbing layer 2 containing metal oxide particles and an acceptor compound with a protective layer having a high degree of strength is particularly effective.

The structure of the photoreceptor 12 is not limited to the aforementioned structure. For example, in the photoreceptor 12, either of the intermediate layer or the protective layer or both of them may be omitted. More specifically, the photoreceptor 12 may have such a structure that the subbing layer 2 and the photosensitive layer 3 are laminated in this order onto the conductive substrate 1; the subbing layer 2, an intermediate layer, and the photosensitive layer 3 are layered in this order onto the conductive substrate 1; or the subbing layer 2, the photosensitive layer 3, and a protective layer are laminated in this order onto the conductive substrate 1.

The lamination of the charge generating layer 31 and the charge transporting layer 32 may be in a reverse order. The photosensitive layer 3 may have a single layer structure, and in this case, the photosensitive layer 3 may a protective layer thereon, or may have the subbing layer 2 and the protective layer thereon. An intermediate layer may be provided on the subbing layer, as mentioned above.

(Developer)

In the image forming apparatus of the invention, either of a one-component developer composed of a toner alone or a two-component developer composed of a toner and a carrier may be employed.

The shape of the toner that can be used in the invention is not particularly limited, but is preferably spherical from the viewpoints of achieving environmental suitability and high quality image. The spherical toner has an average shape factor (SF1) of 100 or more and 150 or less, and preferably 100 or more and 140 or less, in view of achieving high transfer efficiency. If the average shape factor SF1 is more than 140, the transfer efficiency may decrease and the image quality deterioration in the print sample may become apparent to the naked eye.

The spherical toner contains at least a binder resin and a coloring agent. The spherical toner is composed mainly of particles having a diameter of preferably 2 μm or more and 12 μm or less, and more preferably 3 μm or more and 9 μm or less.

Examples of the binder resin include homopolymers and copolymers of styrenes, monoolefins, vinyl esters, α-methylene aliphatic monocarboxylate esters, vinyl ethers, and vinyl ketones. Typical examples of the binder resin include polystyrene, styrene-alkyl acrylic acid copolymers, styrene-alkyl methacrylic acid copolymers, styrene-acrylonitrile copolymers, styrene-butadiene copolymers, styrene-maleic anhydride copolymers, polyethylene, and polypropylene. Other examples include polyester, polyurethane, epoxy resins, silicone resins, polyamide, modified rosin, and paraffin wax.

Typical examples of the coloring agent include magnetic powder such as magnetite and ferrite, carbon black, aniline blue, Calco Oil Blue, chromium yellow, ultramarine blue, Du Pont Oil Red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 17, C. I. Pigment Blue 15:1, and C. I. Pigment Blue 15:3.

Known additives such as a charge control agent, a releasing agent, and other inorganic particles may be internally or externally added to the spherical toner.

Typical examples of the releasing agent include low molecular polyethylene, low molecular polypropylene, Fischer-Tropsch wax, montan wax, carnauba wax, rice wax, and candelilla wax.

The charge control agent may be any known one, and examples thereof include azo metal complex compounds, metal complex compounds of salicylic acid, and resin type charge control agents having a polar group.

Other inorganic particles having an average primary diameter of as small as 40 nm or less may be used for the purpose of controlling the charging property, powder flowability and the like. As necessary, inorganic or organic particles having a larger diameter may be used in combination for the purpose of reducing the adhesion force. These inorganic particles may be selected from known ones.

It is effective that the small inorganic particles are subjected to a surface treatment, which serves to increase the dispersibility to improve powder flowability.

The spherical toner may be produced via any known method without being particularly limited. Specific examples of the method include a kneading-pulverizing method, a method in which the shape of the particles, which have been produced by the kneading-pulverizing method, is changed by applying mechanical shock or heat energy, an emulsion polymerization aggregation method, and a solution suspension method. Furthermore, the spherical toner may have a core-shell structure by attaching aggregated particles to the toner obtained by the above-described method, serving as a core, and then heating to fuse. In cases where an external additive is added to the spherical toner, they are mixed together in a Henschel mixer, a V blender or the like. In cases where the spherical toner is manufactured by a wet process, the external additive may be added via a wet process.

(Image Forming Apparatus)

In the following, the mechanism of the image forming apparatus 10 according to this exemplary embodiment will be described. In the image forming apparatus 10 according to this exemplary embodiment, the charging unit 14 charges the surface of the photoreceptor 12 to impart a predetermined potential. The photoreceptor 12 is rotated around the rotation axis X, and when the portion on the surface of the photoreceptor 12 that has been charged by the charging unit 14 reaches the position equipped with the exposure unit 18, the portion is irradiated with light by the exposure unit 18. As a result of this, an electrostatic latent image according to the image data is formed on the photoreceptor 12.

The photoreceptor 12 is further rotated around the rotation axis X, and when the portion on the photoreceptor 12 having the electrostatic latent image reaches the position equipped with the developing unit 20, the electrostatic latent image is developed with the toner to form a toner image according to the electrostatic latent image on the photoreceptor 12.

The photoreceptor 12 is further rotated and when the portion having the toner image reaches the position equipped with the transfer unit 24, the transfer unit 24 transfers the toner image to the recording medium 27.

After the toner image has been transferred from the outer surface of the photoreceptor 12 onto the recording medium 27 by the rotation of the photoreceptor 12 around the rotation axis X, when the portion at which the toner image is formed reaches the position equipped with the charge removal unit 28, the charges on the surface of the photoreceptor 12 are removed by charge removing light emitted from the charge removing light source 28A of the charge removal unit 28 toward the surface of the photoreceptor 12. Thereafter, the portion is charged again by the charging unit 14.

As described above, the charge removing light source 28A of the charge removal unit 28 emits charge removing light from one end portion toward the other end portion of the photoreceptor 12 in the rotation axis direction Y. The charge removing light source 28A is provided at one end portion of the photoreceptor 12 in the rotation axis direction Y, so that the intensity of the charge removing light decreases in the rotation axis direction Y from the one end portion closer to the charge removing light source 28A toward the other end portion of the photoreceptor 12. However, as described above, the subbing layer 2 of the photoreceptor 12 according to this exemplary embodiment, when included in the photoreceptor 12 and mounted on the image forming apparatus 10, has such a structure that the volume resistance value decreases in the rotation axis direction Y from one end portion closer to the charge removing light source 28A toward the other end portion of the photoreceptor 12, and therefore the sensitivity of the photoreceptor 12 to the charge removing light increases in the rotation axis direction Y from the one end portion closer to the charge removing light source 28A toward the other end portion of the photoreceptor 12.

Accordingly, in the image forming apparatus 10 according to this exemplary embodiment, removal of charges from the surface of the photoreceptor 12 can be performed uniformly or substantially uniformly over the whole area of the surface of the photoreceptor 12 in the rotation axis direction Y, and therefore the remaining of the exposure history (so-called ghosting) on the photoreceptor 12 during image formation can be suppressed.

In addition, in the image forming apparatus 10 according to this exemplary embodiment, the charge removing light source 28A that emits charge removing light toward the surface of the photoreceptor 12 is provided at one end portion of the photoreceptor 12 in the rotation axis direction Y, so that the image forming apparatus 10 may have a simpler structure as compared with the structure having another charge removing light source 28A provided at another portion (for example, the other end portion in the rotation axis direction Y). Accordingly, the image forming apparatus 10 of the invention can suppress the occurrence of ghosting (image defects on the photoreceptor 12 due to the exposure history generated in the previous image formation cycle) even with its simple structure.

FIG. 1 shows an image forming apparatus for forming a monochrome image. The image forming apparatus of the invention is not limited to this type, and may be a tandem type color image forming apparatus including plural image forming units, or a rotary type development apparatus (also referred to as a rotating development apparatus). The rotary type development apparatus here refers to a development apparatus including plural developing units that are rotationally moved in order that only the intended developing unit is positioned opposite to the photoreceptor, whereby toner images of each intended color are sequentially formed on the photoreceptor.

Further, at least one selected from the photoreceptor, charging unit, latent image forming unit, developing unit, and cleaning unit may be integrated with the charge removal unit to constitute a process cartridge which is removable from the image forming apparatus.

Second Exemplary Embodiment

In the first exemplary embodiment, an exemplary structure is described in which the subbing layer 2 is composed of a single layer and the thickness thereof decreases in the rotation axis direction Y from one end portion of the photoreceptor 12 closer to the charge removing light source 28A toward the other end portion, so that the volume resistance value of the subbing layer 2, when included in the photoreceptor 12 and mounted on the image forming apparatus 10, may be regulated to decrease from the one end portion closer to the charge removing light source 28A toward the other end portion in the rotation axis direction Y.

In the second exemplary embodiment, an exemplary structure will be described in which the subbing layer 2 is composed of two layers, and the thicknesses of each of the subbing layer on the conductive substrate 1 side and subbing layer on the photosensitive layer 3 side is regulated, in order that the volume resistance value of the subbing layer 2, when included in the photoreceptor 12 and mounted on the image forming apparatus 10, decreases from the one end portion closer to the charge removing light source 28A toward the other end portion in the rotation axis direction Y.

Figure 4:
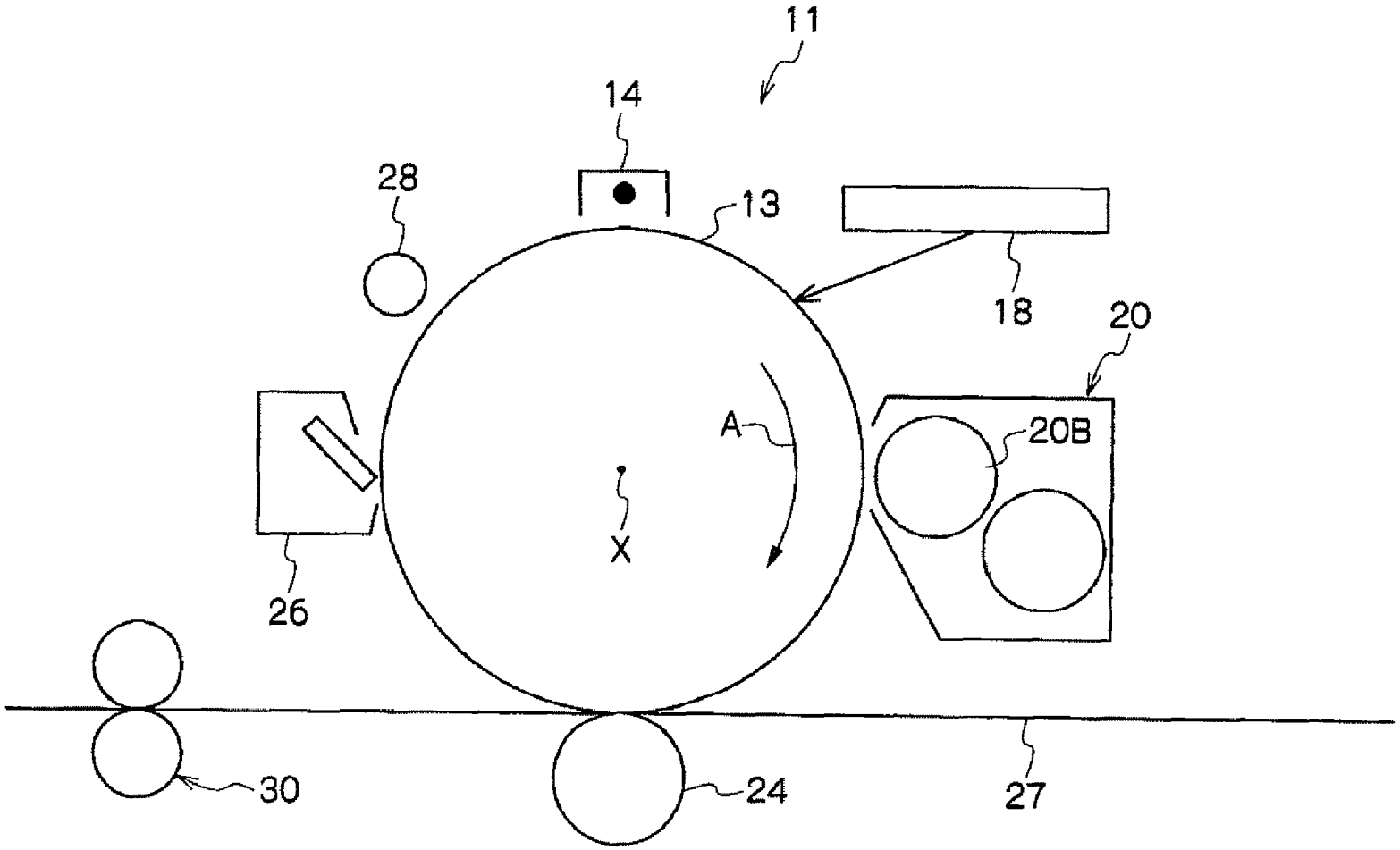
FIG. 4 is a schematic view of an exemplary embodiment according to an image forming apparatus of a second exemplary embodiment.

As shown in FIG. 4, the image forming apparatus 11 according to this exemplary embodiment includes a photoreceptor 13. The photoreceptor 13 has a cylindrical structure, and is provided rotatably around the rotation axis X toward the specified direction (the direction of arrow A in FIG. 4). Around the photoreceptor 13, a charging unit 14, an exposure unit 18, a developing unit 20, a transfer unit 24, a cleaning unit 26, and a charge removal unit 28 are arranged in this order along the rotation direction of the photoreceptor 13 (the direction of arrow A in FIG. 4).

The image forming apparatus 11 according to the exemplary embodiment has the same structure as that of the image forming apparatus 11 according to the first exemplary embodiment, except that the photoreceptor 13 is used in place of the photoreceptor 12. Therefore, the identical units are indicated by the same reference numerals, and the detailed explanation thereof will be omitted.

Figure 5:
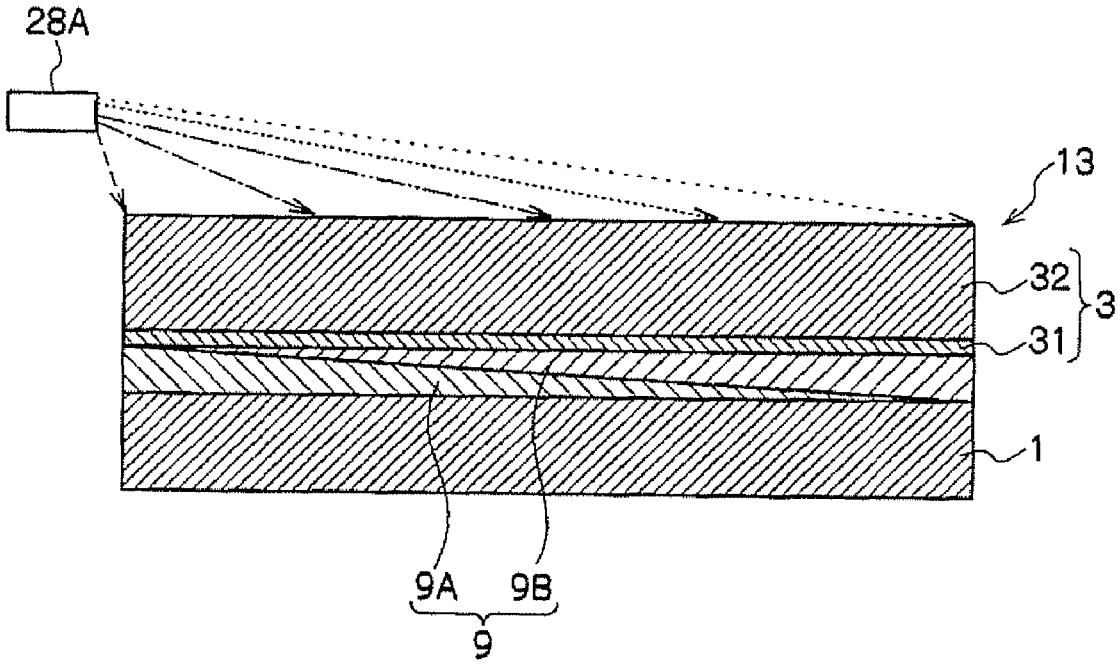
FIG. 5 is a schematic view illustrating a positional relationship of a photoreceptor and a charge removing light source, and a schematic structure of the photoreceptor according to an image forming apparatus of a second exemplary embodiment.

As shown in FIG. 5, the photoreceptor 13 is composed of at least a conductive substrate 1, and onto which are laminated a subbing layer 9 and a photosensitive layer 3 in this order. Detailed structure of the photoreceptor 13 will be described later.

The photoreceptor 13 shown in FIG. 5 is a function-separated type in which the photosensitive layer 3 is composed of a charge generating layer 31 and a charge transporting layer 32.

The photoreceptor 13 according to this exemplary embodiment has the same structure as the photoreceptor 12 according to the first exemplary embodiment, except that the subbing layer 9 is used in place of the subbing layer 2. Therefore, the identical components are indicated by the same reference numerals, and the detailed explanation thereof is omitted.

The subbing layer 9 is formed by applying the subbing layer forming coating solution onto the conductive substrate 1, as is the case with the subbing layer 2 according to the first exemplary embodiment.

As shown in FIG. 5, the subbing layer 9 is composed of the conductive substrate 1, onto which are laminated a subbing layer 9A and a subbing layer 9B in this order.

The volume resistance value of the subbing layer 9, when included in the photoreceptor 13 and mounted on the image forming apparatus 10, is regulated so as to decrease from the one end portion closer to the charge removing light source 28A toward the other end portion in the rotation axis direction Y. The method for measuring the volume resistance value is the same as that described in the first exemplary embodiment, and therefore the detailed description thereof will be omitted.

As described in the case of the photoreceptor 12, the blocking performance to the conductive substrate of the subbing layer 9 when included in the photoreceptor 13 is higher at a portion with a higher volume resistance value, as compared with the blocking performance at a portion with a lower volume resistance value. Therefore, the sensitivity to charge removing light is lower at a portion with a higher volume resistance value of the subbing layer 9, when included in the photoreceptor 13. On the other hand, the blocking performance to the conductive substrate of the subbing layer 9 when included in the photoreceptor 13 is lower at a portion with a lower volume resistance value, as compared with the blocking performance at a portion with a higher volume resistance value. Therefore, the sensitivity to charge removing light is higher at a portion with a lower volume resistance value of the subbing layer 9, when included in the photoreceptor 13.

The charge removing light source 28A of the charge removal unit 28 is provided at one end portion of the photoreceptor 13 in the rotation axis direction Y, and emits charge removing light to at least a region from which charges are to be removed, on the photoreceptor 13 in the rotation axis direction Y. Accordingly, the intensity of the charge removing light emitted from the charge removing light source 28A of the charge removal unit 28 toward the surface of the photoreceptor 13 decreases as the distance from the charge removing light source 28A increases, in the rotation axis direction Y from the one end portion closer to the charge removal unit 28 toward the other end portion of the surface of the photoreceptor 13. The charge removal unit 28 is provided so as to satisfy the above positional relationship.

As mentioned above, in the image forming apparatus 11 according to this exemplary embodiment, the charge removing light source 28A is provided at one end portion of the photoreceptor 13 in the rotation axis direction Y, so that the intensity of the charge removing light emitted from the charge removing light source 28A toward the surface of the photoreceptor 13 decreases in the rotation axis direction Y from one end portion closer to the charge removing light source 28A toward the other end portion of the surface of the photoreceptor 13. On the other hand, the volume resistance value of the subbing layer 9 decreases in the rotation axis direction Y from one end portion closer to the charge removing light source 28A toward the other end portion, and therefore the sensitivity of the photoreceptor 13 increases in the rotation axis direction Y from one end portion closer to the charge removing light source 28A toward the other end portion, thereby prevents the intensity of the charge removing light emitted toward the photoreceptor 13 from being uneven in the rotation axis direction Y.

The volume resistance value at one end portion of the subbing layer 9 closer to the charge removing light source 28A in the rotation axis direction Y (the portion closer to the charge removing light source 28A) is in the same range as that of the volume resistance value discussed in the case of the subbing layer 2 according to the first exemplary embodiment.

In this exemplary embodiment, in order to adjust the volume resistance value of the subbing layer 9 so as to decrease from the one end closer to the charge removing light source 28A toward the other end in the rotation axis direction Y as described above, as shown in FIG. 5, the subbing layer 9 has a two-layer structure in which the subbing layer 9B is laminated on the subbing layer 9A, the thickness of the subbing layer 9A decreases from the one end closer to the charge removing light source 28A toward the other end in the rotation axis direction Y, and the thickness of the subbing layer 9B increases from the one end closer to the charge removing light source 28A toward the other end in the rotation axis direction Y. The subbing layer 9A is thicker than the subbing layer 9B at the side closer to the charge removing light source 28A, whereas the subbing layer 9A is thinner than the subbing layer 9B at the other side.

The volume resistivity of the subbing layer 9A is in the range of from $1.0\times10^{8.2}$ Ω·cm to $1.0\times10^{14.8}$ Ω·cm, or from about $1.0\times10^{8.2}$ Ω·cm to about $1.0\times10^{14.8}$ Ω·cm.

The volume resistivity of the subbing layer 9B is in the range of from $1.0\times10^{14.8}$ Ω·cm to $1.0\times10^{8.2}$ Ω·cm, or from about $1.0\times10^{14.8}$ Ω·cm to $1.0\times10^{8.2}$ Ω·cm.

If the volume resistance value of the subbing layer 9A is less than $1.0\times10^{8.2}$ Ω·cm, or less than about $1.0\times10^{8.2}$ Ω·cm, there is a fear that the image density may significantly decrease, and if it is more than $1.0\times10^{14.8}$ Ω·cm, or more than about $1.0\times10^{14.8}$ Ω·cm, there is a fear that the image density may increase. The same applies to the volume resistivity of the subbing layer 9B.

The subbing layer 9A and the subbing layer 9B correspond to the first subbing layer and the second subbing layer of the image forming apparatus of the invention, respectively.

In this exemplary embodiment, the portions of the subbing layers 9A and 9B being "closest to the charge removing light source 28A in the rotation axis direction Y" refer to the portions closest to the charge removing light source 28A in the rotation axis direction Y, at which the subbing layer 9A has the largest thickness and the subbing layer 9B has the least thickness.

In addition, in this exemplary embodiment, the portions of the subbing layers 9A and 9B being "farthest from the charge removing light source 28A in the rotation axis direction Y" refer to the portions farthest from the charge removing light source 28A in the rotation axis direction Y, at which the subbing layer 9A has the least thickness and the subbing layer 9B has the largest thickness.

The thickness of the subbing layer 9 itself, having a two-layer structure of the subbing layer 9A and the subbing layer 9B laminated thereon, is preferably approximately uniform or substantially uniform in the rotation axis direction Y. If the above thickness is not uniform, the film thickness of the whole photosensitive layer may become uneven and may cause difficulty in interaction with other members, thereby making the apparatus instable. On the other hand, when the thickness of the subbing layer 9 is uniform or substantially uniform in the rotation axis direction Y, exposure by the exposure unit 18 and development by the developing unit 20 can be prevented from being uneven, thereby further suppressing image quality deterioration.

The subbing layer 9 composed of the subbing layers 9A and 9B can be formed onto the conductive substrate 1 by applying a subbing layer coating solution for the subbing layer 9A onto the conductive substrate 1, and then applying a subbing layer coating solution for the subbing layer 9B onto the subbing layer 9A.

The thickness of the subbing layers 9A and 9B can be regulated in the same manner as in the thickness of the subbing layer 2 according to the first exemplary embodiment.

The subbing layers 9A and 9B can be formed in the same manner as in the subbing layer 2 according to the first exemplary embodiment, i.e., by applying subbing layer forming coating solutions containing metal oxide particles, additives, a curable resin, a curing agent, and a solvent, onto the conductive substrate 1 to give the intended thickness, and then curing the coatings.

The subbing layers 9A and 9B preferably contain the metal oxide particles of the same metal element. Further, the subbing layers 9A and 9B preferably contain the same materials at the same mixing ratio, and have the same or substantially the same composition.

As described above, when the subbing layers 9A and 9B contain the metal oxide particles of the same metal element and have the same composition, production cost of the photoreceptor 13 can be reduced and the productivity thereof can be improved.

The volume resistivities of the subbing layers 9A and 9B can be regulated to fall within the intended range by regulating the mixing conditions for the metal oxide particles in the same manner as that described in the first exemplary embodiment. More specifically, the volume resistivities of the subbing layers 9A and 9B, which compose the subbing layer 9 of the photoreceptor 13 mounted on the image forming apparatus 11 according to the exemplary embodiment, can be regulated to fall within the intended range by, for example, preparing the subbing layer forming coating solutions so that the volume resistivities thereof may fall within the intended range.

(Image Forming Apparatus)

In the following, the mechanism of the image forming apparatus 11 according to this exemplary embodiment will be described. In the image forming apparatus 11 according to this exemplary embodiment, the charging unit 14 charges the surface of the photoreceptor 13 to a predetermined potential. The photoreceptor 13 is rotated around the rotation axis X, and when the portion on the surface of the photoreceptor 13 that has been charged by the charging unit 14 reaches the position equipped with the exposure unit 18, the portion is irradiated with light by the exposure unit 18. As a result of this, an electrostatic latent image according to the image data is formed on the photoreceptor 13.

The photoreceptor 13 is further rotated around the rotation axis X, and when the portion of the photoreceptor 13 having the electrostatic latent image reaches the position equipped with the developing unit 20, the electrostatic latent image is developed with the toner to form a toner image according to the electrostatic latent image on the photoreceptor 13.

The photoreceptor 13 is further rotated and when the portion having the toner image reaches the position equipped with the transfer unit 24, the transfer unit 24 transfers the toner image onto the recording medium 27.

After the toner image has been transferred from the outer surface of the photoreceptor 13 onto the recording medium 27 by the rotation of the photoreceptor 13 around the rotation axis X, when the portion at which the toner image was formed reaches the position equipped with the charge removal unit 28, charges on the surface of the photoreceptor 13 are removed by charge removing light emitted from the charge removing light source 28A of the charge removal unit 28 toward the surface of the photoreceptor 13. Thereafter, the portion is charged again by the charging unit 14.

As described above, the charge removing light source 28A of the charge removal unit 28 emits charge removing light from one end portion toward the other end portion of the photoreceptor 13 in the rotation axis direction Y. The charge removing light source 28A is provided at one end portion of the photoreceptor 13 in the rotation axis direction Y, so that the intensity of the charge removing light decreases in the rotation axis direction Y from the one end portion closer to the charge removing light source 28A toward the other end portion of the photoreceptor 13. However, as described above, the subbing layer 9 of the photoreceptor 13 according to this exemplary embodiment, when included in the photoreceptor 13 and mounted on the image forming apparatus 11, has such a structure that the volume resistance value decreases in the rotation axis direction Y from one end portion closer to the charge removing light source 28A toward the other end portion of the photoreceptor 13, and therefore the sensitivity of the photoreceptor 13 to the charge removing light increases in the rotation axis direction Y from the one end portion closer to the charge removing light source 28A toward the other end portion of the photoreceptor 13.

Accordingly, in the image forming apparatus 11 according to this exemplary embodiment, removing of charges from the surface of the photoreceptor 13 can be performed uniformly or substantially uniformly over the whole area of the surface of the photoreceptor 13 in the rotation axis direction Y, and therefore the remaining of the exposure history (so-called ghosting) on the photoreceptor 13 during image formation can be suppressed.

In addition, in the image forming apparatus 11 according to this exemplary embodiment, the charge removing light source 28A that emits charge removing light toward the surface of the photoreceptor 13 is provided at one end portion of the photoreceptor 13 in the rotation axis direction Y, so that the image forming apparatus 11 may have a simpler structure as compared with the structure having another charge removing light source 28A provided at another portion (for example, the other end portion in the rotation axis direction Y). Accordingly, the image forming apparatus 11 of the invention can suppress the occurrence of ghosting (image defects on the photoreceptor 13 due to the exposure history generated in the previous image formation cycle) even with its simple structure.

FIG. 4 shows an image forming apparatus for forming a monochrome image. The image forming apparatus of the invention is not limited to this type, and may be a tandem type color image forming apparatus including plural image forming units, or a rotary type development apparatus (also referred to as a rotating development apparatus). The rotary type development apparatus here refers to a development apparatus including plural developing units that are rotationally moved in order that only the intended developing unit is positioned opposite to the photoreceptor, whereby toner images of each intended color are sequentially formed on the photoreceptor.

Further, at least one selected from the photoreceptor, charging unit, latent image formation unit, developing unit, and cleaning unit may be integrated with the charge removal unit to constitute a process cartridge which is removable from the image forming apparatus.

EXAMPLES

In the following, further details of the invention will be provided with reference to the examples and comparative examples. However, the invention will not be limited to these examples in any way.

Example A1

100 parts by weight of zinc oxide particles (metal oxide particles, average particle diameter: 70 nm, a test product of TAYCA Corporation, BET specific surface area: 15 $m^2/g$) and 500 parts by weight of toluene are mixed and stirred, then 1.25 parts by weight of a silane coupling agent (KBM603, a product of Shin-Etsu Chemical Co., Ltd.) is added and further stirred for two hours. The toluene is removed by vacuum distillation and baking is conducted at 120° C. for three hours. A zinc oxide pigment treated with a silane coupling agent is thus obtained.

60 parts by weight of the above surface-treated zinc oxide, 0.3 part by weight of alizarin (a product of SIGMA-ALDRICH JAPAN K. K.), 13.5 parts by weight of a block-type isocyanate (a product of Sumitomo Bayer Urethane Co., Ltd., SUMIJULE 3175) as a curing agent, 15 parts by weight of a butyral resin (a product of SEKISUI CHEMICAL CO., LTD., S-LEC BM-1) are mixed in 85 parts by weight of methyl ethyl ketone, and 38 parts by weight of this solution is mixed with 25 parts by weight of methyl ethyl ketone and dispersed in a sand mill using glass beads with a diameter of 1 mm.

The sample of the obtained dispersion is applied on a glass plate so that the thickness of this after drying is 20 μm, and light transmission of the dried film against light having a wavelength of 950 nm is measured by a spectrophotometer. The dispersion process is stopped when the light transmission reaches 30%, and a dispersion for forming a subbing layer is obtained.

The volume resistivity of the above sample used for measuring light transmission is $1.0\times10^{12.5}$ (Ω·cm).

The above volume resistivity is obtained by applying a voltage adjusted to give an electric field of 1000 V/cm (applied voltage/composition sheet thickness) to the sample sheet for 30 seconds using a measurement tool (R12702A/B Resistivity Chamber, manufactured by Advantest Corporation) and a high resistance meter (R8340A digital high resistance/minute ammeter, manufactured by Advantest Corporation), and then calculating the volume resistivity by the following formula on the basis of the applied voltage and the current value after the application of the voltage.

Volume resistivity (Ω·cm)=(19.63×applied voltage (V))/(current value (A)×composition sheet thickness (cm))

To the above dispersion, 0.005 parts by weight of dioctyltin dilaurate as a catalyst and 4.0 parts by weight of a silicone resin particles (manufactured by GE Toshiba Silicones Co., Ltd., TOSPEARL 145) are added, thereby obtaining a coating solution for forming a subbing layer.

The resulting coating solution is applied by a dipping method onto an aluminum cylindrical substrate of 30 mm in diameter, 404 mm in length and 1 mm in thickness, such that the application rate can be changed in a direction of rotation axis Y from one end to the other end of the substrate to give variation in film thickness. The film thickness is regulated to decrease in a rotation axis direction from the end portion of the substrate closer to a charge removing light source, when mounted in an image formation apparatus, toward the other end portion of the substrate, in a continuous manner.

The applied coating solution is dried and cured at 195° C. for 27 minutes, thereby obtaining a subbing layer having the average thickness of 20 μm, the largest thickness of 23 μm at a portion closest to a charge removing light source, and the smallest thickness of 17 μm at a portion farthest from the charge removing light source, in a rotation axis direction.

The volume resistance value of the above subbing layer is measured at five points at predetermined intervals (60 mm), from one end to the other end of the substrate in a rotation axis direction. The volume resistance values at a portion closest to the charge removing light source (having the largest thickness) and at a portion farthest from the charge removing light source (having the smallest thickness) are $1.0\times10^{8.57}\Omega$ and $1.0\times10^{8.44}\Omega$, respectively. Moreover, it is observed that the volume resistance values between the above two points show a decreasing trend from $1.0\times10^{8.57}\Omega$ toward $1.0\times10^{8.44}\Omega$.

Next, a photosensitive layer is formed on the subbing layer. A mixture of 15 parts by weight of chlorogalliumphthalocyanine as a charge generating material, 10 parts by weight of vinyl chloride/vinyl acetate copolymer as a binder resin (a product of Union Carbide Corporation, VMCH), and 200 parts by weight of n-butyl acetate is dispersed for four hours in a sand mill using glass beads with a diameter of 1 mm. 175 parts by weight of n-butyl acetate and 180 parts by weight of methyl ethyl ketone are added in the dispersion and stirred, thereby obtaining a coating solution for a charge generating layer. The solution is applied onto the subbing layer by a dipping method and dried at normal temperature (25° C.) to give a charge generating layer having a thickness of 0.2 μm.

A charge transport layer having a thickness of 25 μm is further formed on the charge generating layer by applying a solution prepared by dissolving 4 parts by weight of N,N'-diphenyl-N,N'-bis(3-methylphenyl)-[1,1']biphenyl-4,4'-diamine and 6 parts by weight of bisphenol Z polycarbonate resin (viscosity average molecular weight: 40,000) in 80 parts by weight of tetrahydrofuran, and then drying at 115° C. for 40 minutes. The photoreceptor is thus obtained.

The obtained photoreceptor is mounted to a printer (manufactured by Fuji Xerox Co., Ltd., DocuCentre Color II 4300) modified such that an LED (a light source that irradiates charge removing light) emits charge removing light to the surface of the photoreceptor from only one end portion toward the other end portion thereof in a rotation direction Y (shown in FIG. 2), and equipped with a process cartridge with a light shielding member that shields the outside region of the region from which charges are to be removed from light irradiation.

At this time, the photoreceptor is mounted to the printer in such a manner that the end at which the subbing layer has a larger thickness (higher volume resistance value) is positioned at the side closer to the light source, and the end at which the subbing layer has a less thickness (lower volume resistance value) is positioned at the side away from the light source.

<Density Evaluation>

In the above image forming apparatus, full-area half-tone magenta images having a density of 30% are formed on 30 sheets of A3 recording paper in a continuous manner in conditions of charge potential on the surface of the photoreceptor after being charged by a charging unit: −700 V, exposure energy to the photoreceptor by a exposure unit: 4.5 $mJ/m^2$, and rotation rate: 165 mm/sec.

The external environment at the time of printing is set at 22° C. and 50% RH. After the continuous formation of 30 sheet images, density of the image printed on the 30th sheet is measured at the center and at the two ends corresponding to the rotation axis direction Y of the photoreceptor. The measurement is carried out using a densitometer (X-Rite 404, a product of X-Rite, Inc.).

The difference in the density at the center portion in the image and the density at one of the two ends in the image in the rotation axis direction Y, and the difference in the density at the center portion in the image and the density at the other one of the two ends in the image in the rotation axis direction Y are compared, and the wider value thereof is shown in Table 1 as "ΔD".

In Table 1, when the value of ΔD is smaller, it is evaluated that a higher degree of in-plane density uniformity is achieved. On the other hand, when the value of ΔD is larger, it is evaluated that a high degree of in-plane density uniformity is not achieved. When the value of ΔD is more than 0.2, it is evaluated as "NG" meaning the existence of an image deterioration.

<Ghosting Evaluation>

The existence or not of image defects due to an image record remaining from the previous printing process (ghosting) is visually observed.

<Surface Potential Evaluation>

The printer used in the above evaluation is further equipped with a potential measurement probe (a product of TREK INC., Trek 344) at a position downstream of the position at which the photoreceptor is irradiated with charge removing light, and upstream of the position at which the photoreceptor is charged by a charging unit.

The surface potential of the photoreceptor is measured at a position closest to the charge removing light source and at a position farthest from the charge removing light source, in the rotation axis direction Y, immediately after the irradiation with charge removing light has been performed at the time of the 30th image formation.

The difference in the surface potentials (the difference between the surface potential measured at a position closest to the charge removing light source and the surface potential measured at a position farthest from the charge removing light source in the rotation axis direction Y) is shown in Table 1 as "ΔV".

In the evaluation of the surface potential, image formation is conducted in the conditions of charge potential on the surface of the photoreceptor after being charged by a charging unit: −700 V, exposure energy to the photoreceptor by a exposure unit: 4.5 mJ/m$^2$, and rotation rate: 165 mm/sec.

Example A2

A photoreceptor is prepared in a substantially same manner as that in Example A1, except that the thickness of the subbing layer is different, and the density, ghosting and surface potential are evaluated in a manner as described in Example A1.

In Example A2, the speed of applying a subbing layer forming solution is regulated such that the layer after being dried and cured at 195° C. for 27 minutes has the average thickness of 20 μm, a thickness of 25 μm at a position closest to the charge removing light source (the thickness is largest), and 15 μm at a position farthest from the charge removing light source (the thickness is smallest).

The volume resistance value of the subbing layer of Example A2 is measured at five points at predetermined intervals (60 mm), from one end to the other end of the aluminum substrate in the rotation axis direction Y. The volume resistance values at a portion closest to the charge removing light source (having the largest thickness) and at a portion farthest from the charge removing light source (having the smallest thickness) are $1.0\times10^{8.61}\Omega$ and $1.0\times10^{8.38}\Omega$, respectively. Moreover, it is observed that the volume resistance values between the above two points show a decreasing trend from $1.0\times10^{8.61}\Omega$ toward $1.0\times10^{8.38}\Omega$.

The results of evaluations of the density, ghosting, and surface potential are shown in Table 1.

Example A3

A photoreceptor is prepared in a substantially same manner as that in Example A1, except that the thickness of the subbing layer is different, and the density, ghosting and surface potential are evaluated in a manner as described in Example A1.

In Example A3, the speed of applying a subbing layer forming solution is regulated such that the layer after being dried and cured at 195° C. for 27 minutes has the average thickness of 25 μm, a thickness of 27 μm at a position closest to the charge removing light source (the thickness is largest), and 24 μm at a position farthest from the charge removing light source (the thickness is smallest).

The volume resistance value of the subbing layer of Example A3 is measured at five points at predetermined intervals (60 mm), from one end to the other end of the aluminum substrate in the rotation axis direction Y. The volume resistance values at a portion closest to the charge removing light source (having the largest thickness) and at a portion farthest from the charge removing light source (having the smallest thickness) are $1.0\times10^{8.64}\Omega$ and $1.0\times10^{8.59}\Omega$, respectively. Moreover, it is observed that the volume resistance values between the above two points show a decreasing trend from $1.0\times10^{8.64}\Omega$ toward $1.0\times10^{8.59}\Omega$.

The results of evaluations of the density, ghosting, and surface potential are shown in Table 1.

Example A4

A photoreceptor is prepared in a substantially same manner as that in Example A1, except that titanium oxide is used in place of zinc oxide as the metal oxide particles, and the density, ghosting and surface potential are evaluated in a manner as described in Example A1.

The volume resistivity of a sample for the measurement of light transmission obtained in Example A4, as measured in the same manner as in Example A1, is $1.0\times10^{10.4}$ (Ω·cm).

The volume resistance value of the subbing layer of Example A4 is measured at five points at predetermined intervals (60 mm), from one end to the other end of the aluminum substrate in the rotation axis direction Y. The volume resistance values at a portion closest to the charge removing light source (having the largest thickness) and at a portion farthest from the charge removing light source (having the smallest thickness) are $1.0\times10^{6.47}\Omega$ and $10.0\times10^{6.34}\Omega$, respectively. Moreover, it is observed that the volume resistance values between the above two points show a decreasing trend from $1.0\times10^{6.47}\Omega$ toward $1.0\times10^{6.34}\Omega$.

The results of evaluations of the density, ghosting, and surface potential are shown in Table 1.

Example A5

A photoreceptor is prepared in a substantially same manner as that in Example A1, except that the thickness of the subbing layer is different, and the density, ghosting and surface potential are evaluated in a manner as described in Example A1.

In Example A5, the speed of applying a subbing layer forming solution is regulated such that the layer after being dried and cured at 195° C. for 27 minutes has the average thickness of 25 μm, a thickness of 26 μm at a position closest to the charge removing light source (the thickness is largest), and 24 μm at a position farthest from the charge removing light source (the thickness is smallest).

The volume resistance value of the subbing layer of Example A5 is measured at five points at predetermined intervals (60 mm), from one end to the other end of the aluminum substrate in a rotation axis direction Y. The volume resistance values at a portion closest to the charge removing light source (having the largest thickness) and at a portion farthest from the charge removing light source (having the smallest thickness) are $1.0\times10^{8.62}\Omega$ and $1.0\times10^{8.59}\Omega$, respectively. Moreover, it is observed that the volume resistance values between the above two points show a decreasing trend from $1.0\times10^{8.62}\Omega$ toward $1.0\times10^{8.59}\Omega$.

The results of evaluations of the density, ghosting, and surface potential are shown in Table 1. In Example A5, a slight degree of ghosting is observed but is evaluated as acceptable is practical use.

Comparative Example A1

A photoreceptor is prepared in a substantially same manner as that in Example A1, except that the thickness of the subbing layer is different, and the density, ghosting and surface potential are evaluated in a manner as described in Example A1.

In Comparative Example A1, the speed of applying a subbing layer forming solution is regulated such that the layer after being dried and cured at 195° C. for 27 minutes has the average thickness of 20 μm, a thickness of 17 μm at a position closest to the charge removing light source (the thickness is smallest), and 23 μm at a position farthest from the charge removing light source (the thickness is largest).

The volume resistance value of the subbing layer of Comparative Example A1 is measured at five points at predetermined intervals (60 mm), from one end to the other end of the aluminum substrate in a rotation axis direction Y. The volume resistance values at a portion closest to the charge removing light source (having the smallest thickness) and at a portion farthest from the charge removing light source (having the largest thickness) are $1.0\times10^{8.44}\Omega$ and $1.0\times10^{8.57}\Omega$, respectively. Moreover, it is observed that the volume resistance values between the above two points show an increasing trend from $1.0\times10^{8.44}\Omega$ toward $1.0\times10^{8.57}\Omega$.

The results of evaluations of the density, ghosting, and surface potential are shown in Table 1.

Comparative Example A2

A photoreceptor is prepared in a substantially same manner as that in Example A1, except that the thickness of the subbing layer is uniform, and the density, ghosting and surface potential are evaluated in a manner as described in Example A1.

In Comparative Example A2, the speed of applying a subbing layer forming solution is regulated such that the layer after being dried and cured at 195° C. for 27 minutes has the average thickness of 20 μm, a thickness of 20 μm at a position closest to the charge removing light source (the thickness is smallest), and 20 μm at a position farthest from the charge removing light source (the thickness is largest).

The volume resistance value of the subbing layer of Comparative Example A2 is measured at five points at predetermined intervals (60 mm), from one end to the other end of the aluminum substrate in the rotation axis direction Y. The volume resistance values at a portion closest to the charge removing light source (having the smallest thickness) and at a portion farthest from the charge removing light source (having the largest thickness) are $1.0\times10^{8.51}\Omega$ and $1.0\times10^{8.51}\Omega$, respectively. Moreover, it is observed that the volume resistance values between the above two points are constant at $1.0\times10^{8.51}\Omega$.

The results of evaluations of the density, ghosting, and surface potential are shown in Table 1.

TABLE 1

| | | Example A1 | Example A2 | Example A3 | Example A4 | Example A5 | Comp. Example A1 | Comp. Example A2 |
|---|---|---|---|---|---|---|---|---|
| Metal oxide particles | | Zinc oxide | Zinc oxide | Zinc oxide | Titanium oxide | Zinc oxide | Zinc oxide | Zinc oxide |
| Volume resistivity (Ω · cm) | | $1.0\times10^{12.5}$ | $1.0\times10^{12.5}$ | $1.0\times10^{12.5}$ | $1.0\times10^{10.4}$ | $1.0\times10^{12.5}$ | $1.0\times10^{12.5}$ | $1.0\times10^{12.5}$ |
| Average thickness (μm) | | 20 | 20 | 25 | 20 | 25 | 20 | 20 |
| Closest position to charge removing light source | Thickness A (μm) | 23 | 25 | 27 | 23 | 26 | 17 | 20 |
| | Volume resistance value (Ω) | $1.0\times10^{8.57}$ | $1.0\times10^{8.61}$ | $1.0\times10^{8.64}$ | $1.0\times10^{6.47}$ | $1.0\times10^{8.62}$ | $1.0\times10^{8.44}$ | $1.0\times10^{8.51}$ |
| Fartherst position from charge removing light source | Thickness B (μm) | 17 | 15 | 24 | 17 | 24 | 23 | 20 |
| | Volume resistance value (Ω) | $1.0\times10^{8.44}$ | $1.0\times10^{8.38}$ | $1.0\times10^{8.59}$ | $1.0\times10^{6.34}$ | $1.0\times10^{8.59}$ | $1.0\times10^{8.57}$ | $1.0\times10^{8.51}$ |
| Difference in thickness ((B/A) × 100, %) | | 30 | 50 | 12 | 30 | 8 | −30 | 0 |
| Difference in density (ΔD) | | 0.06 | 0.17 | 0.13 | 0.11 | 0.25 | 0.48 | 0.42 |
| Difference in surface potential (ΔV) | | 2.3 | 9.5 | 6.5 | 4.8 | 12.5 | 18.5 | 18.0 |
| Ghosting | | None | None | None | None | Slightly observed but acceptable in practical use | Problem ghosting is observed | Problem ghosting is observed |

Example B1

100 parts by weight of zinc oxide particles (metal oxide particles, average particle diameter: 70 nm, a test product of TAYCA Corporation, BET specific surface area: 15 $m^2/g$) and 500 parts by weight of toluene are mixed and stirred, then 1.25 parts by weight of a silane coupling agent (KBM603, a product of Shin-Etsu Chemical Co., Ltd.) is added and further stirred for two hours. The toluene is removed by vacuum distillation and baking is conducted at 120° C. for three hours. A zinc oxide pigment treated with a silane coupling agent is thus obtained.

60 parts by weight of the above surface-treated zinc oxide, 0.3 part by weight of alizarin (a product of SIGMA-ALDRICH JAPAN K. K.), 13.5 parts by weight of a block-type isocyanate (a product of Sumitomo Bayer Urethane Co., Ltd., SUMIJULE 3175) as a curing agent, 15 parts by weight of a butyral resin (a product of SEKISUI CHEMICAL CO., LTD., S-LEC BM-1) are mixed in 85 parts by weight of methyl ethyl ketone, and 38 parts by weight of this solution is mixed with 25 parts by weight of methyl ethyl ketone and dispersed in a sand mill using glass beads with a diameter of 1 mm.

The sample of the obtained dispersion (referred to as dispersion S) is applied onto a glass plate so that the thickness of this after drying is 20 μm, and light transmission of the dried film against light having a wavelength of 950 nm is measured by a spectrophotometer. The dispersion process is stopped when the light transmission reaches 80%, and a subbing layer forming dispersion A is obtained.

The volume resistivity, measured in the same manner as in Example A1, of the above sample used for measuring light transmission is $1.0\times10^{12.5}$ (Ω·cm).

In the same manner as in the above dispersion A, a sample of the dispersion S is applied onto a glass plate so that the thickness of this after drying is 20 μm, and light transmission of the dried film against light having a wavelength of 950 nm is measured by a spectrophotometer. The dispersion process is stopped when the light transmission reaches 25%, and a subbing layer forming dispersion B is obtained.

The volume resistivity, measured in the same manner as in Example A1 of the above sample used for measuring light transmission is $1.0\times10^{10}$ (Ω·cm).

To the above subbing layer forming dispersions A and B, respectively, 0.005 parts by weight of dioctyltin dilaurate as a catalyst and 4.0 parts by weight of a silicone resin particles (manufactured by GE Toshiba Silicones Co., Ltd., TOSPEARL 145) are added, thereby obtaining subbing layer forming solutions A and B.

The subbing layer forming solution A is applied by a dipping method onto an aluminum cylindrical substrate of 30 mm in diameter, 404 mm in length and 1 mm in thickness, such that the application rate can be changed in a direction of rotation axis Y from one end to the other end of the substrate to give variation in film thickness. The film thickness is regulated to decrease in a rotation axis direction from the end portion of the substrate closer to a charge removing light source, when mounted in an image formation apparatus, toward the other end portion of the substrate, in a continuous manner.

The subbing layer forming solution B is then applied onto the subbing layer forming solution A applied on the aluminum substrate, such that the application rate is changed in a direction of rotation axis Y from one end to the other end of the substrate to give variation in film thickness. The film thickness is regulated to increase in the rotation axis direction Y from the end portion of the substrate closer to a charge removing light source, when mounted in an image formation apparatus, toward the other end portion of the substrate, in a continuous manner.

After drying and curing at 195° C. for 27 minutes, a subbing layer having a two layer structure composed of a subbing layer A of the solution A and a subbing layer B of the solution B is obtained. This subbing layer has a constant thickness of 22 μm in the rotation axis direction Y.

The volume resistance value of the above subbing layer having a two-layer structure is measured at five points at predetermined intervals (60 mm), from one end to the other end of the substrate in a rotation axis direction. The volume resistance values at a portion closest to the charge removing light source and at a portion farthest from the charge removing light source are $1.0\times10^{12.41}$Ω and $1.0\times10^{11.99}$Ω, respectively. Moreover, it is observed that the volume resistance values between the above two points show a decreasing trend from $1.0\times10^{12.41}$Ω toward $1.0\times10^{11.99}$Ω. The volume resistance values are measured in the same manner as in Example A1.

Next, a photosensitive layer is formed on the subbing layer. A mixture of 15 parts by weight of chlorogalliumphthalocyanine as a charge generating material, 10 parts by weight of vinyl chloride/vinyl acetate copolymer as a binder resin (a product of Union Carbide Corporation, VMCH), and 200 parts by weight of n-butyl acetate is dispersed for four hours in a sand mill using glass beads with a diameter of 1 mm. 175 parts by weight of n-butyl acetate and 180 parts by weight of methyl ethyl ketone are added in the dispersion and stirred, thereby obtaining a coating solution for a charge generating layer. The solution is applied onto the subbing layer by a dipping method and dried at normal temperature to give a charge generating layer having a thickness of 0.2 μm.

A charge transport layer having a thickness of 25 μm is further formed on the charge generating layer by applying a solution prepared by dissolving 4 parts by weight of N,N'-diphenyl-N,N'-bis(3-methylphenyl)-[1,1']biphenyl-4,4'-diamine and 6 parts by weight of bisphenol Z polycarbonate resin (viscosity average molecular weight: 40,000) in 80 parts by weight of tetrahydrofuran, and then drying at 115° C. for 40 minutes. The photoreceptor is thus obtained.

The obtained photoreceptor is mounted to a printer (manufactured by Fuji Xerox Co., Ltd., DocuCentre Color II 4300) modified such that an LED (a light source that irradiates charge removing light) emits charge removing light to the surface of the photoreceptor from only one end portion toward the other end portion thereof in a rotation direction Y (shown in FIG. 2), and equipped with a process cartridge with a light shielding member that shields the outside region of the region from which charges are to be removed from light irradiation.

At this time, the photoreceptor is mounted to the printer in such a manner that the end at which the volume resistance value is higher is positioned at the side closer to the light source in the rotation axis direction Y, and the end at which the volume resistance value is lower is positioned at the side away from the light source in the rotation axis direction Y.

<Density Evaluation>

In the above image forming apparatus, full-area half-tone magenta images having a density of 30% are formed on 30 sheets of A3 recording paper in a continuous manner in conditions of charge potential on the surface of the photoreceptor after being charged by a charging unit: −700 V, exposure energy to the photoreceptor by a exposure unit: 4.5 mJ/m$^2$, and rotation rate: 165 mm/sec. The external environment at the time of printing is set at 22° C. and 50% RH.

After the continuous formation of 30 sheet images, density of the image printed on the 30th sheet is measured at the center and at the two ends corresponding to the rotation axis direction Y of the photoreceptor. The measurement is carried out using a densitometer (X-Rite 404, a product of X-Rite, Inc.).

The difference in the density at the center portion in the image and the density at one of the two ends in the image in the rotation axis direction Y, and the difference in the density at the center portion in the image and the density at the other one of the two ends in the image in the rotation axis direction Y are compared, and the wider value thereof is shown in Table 2 as "ΔD".

In Table 2, when the value of ΔD is smaller, it is evaluated that a higher degree of in-plane density uniformity is achieved. On the other hand, when the value of ΔD is larger, it is evaluated that a high degree of in-plane density uniformity is not achieved. When the value of ΔD is more than 0.2, it is evaluated as "NG" meaning the existence of an image deterioration.

<Ghosting Evaluation>

The existence or not of image defects due to an image record remaining from the previous printing process (ghosting) is visually observed.

<Surface Potential Evaluation>

The printer used in the above evaluation is further equipped with a potential measurement probe (a product of TREK INC., Trek 344) at a position downstream of the position at which the photoreceptor is irradiated with charge removing light, and upstream of the position at which the photoreceptor is charged by a charging unit.

The surface potential of the photoreceptor is measured at a position closest to the charge removing light source and at a position farthest from the charge removing light source, in the rotation axis direction Y, immediately after the irradiation with charge removing light has been performed at the time of the 30th image formation as descried above.

The difference in surface potential (the difference between the surface potential measured at a position closest to the charge removing light source and the surface potential measured at a position farthest from the charge removing light source in the rotation axis direction Y) is shown in Table 2 as "ΔV".

In the evaluation of the surface potential, image formation is conducted in the conditions of charge potential on the surface of the photoreceptor after being charged by a charging unit: −700 V, exposure energy to the photoreceptor by a exposure unit: 4.5 mJ/m$^2$, and rotation rate: 165 mm/seq.

Example B2

A photoreceptor is prepared in a substantially same manner as that in Example B1, except that titanium oxide is used in place of zinc oxide as the metal oxide particles in the coating solution B, and the density, ghosting and surface potential are evaluated in a manner as described in Example B1.

The volume resistivity, as measured in the same manner as in Example B1, of the sample of the coating solution B used for measuring light transmission is $1.0\times10^{10.3}$ (Ω·cm).

The volume resistance value of the subbing layer having a two-layer structure of Example B2 is measured at five points at predetermined intervals (60 mm), from one end to the other end of the aluminum substrate in a rotation axis direction Y. The volume resistance values at a portion closest to the charge removing light source and at a portion farthest from the charge removing light source are $1.0\times10^{12.41}\Omega$ and $1.0\times10^{11.99}\Omega$, respectively. Moreover, it is observed that the volume resistance values between the above two points show a decreasing trend from $1.0\times10^{12.41}\Omega$ toward $1.0\times10^{11.99}\Omega$.

The results of evaluations of the density, ghosting, and surface potential are shown in Table 2.

Example B3

A photoreceptor is prepared in a substantially same manner as that in Example B1, except that alizarin (having a property to serve as an acceptor) is not added in both of the subbing layer forming solutions A and B, and the density, ghosting and surface potential are evaluated in a manner as described in Example B1.

The volume resistivities, measured in the same manner as in Example B1, of the samples of the coating solutions A and B used for measuring light transmission are $1.0\times10^{12.8}$ (Ω·cm) and $1.0\times10^{10.8}$ (Ω·cm), respectively.

The volume resistance value of the subbing layer having a two-layer structure of Example B3 is measured at five points at predetermined intervals (60 mm), from one end to the other end of the aluminum substrate in a rotation axis direction Y. The volume resistance values at a portion closest to the charge removing light source and at a portion farthest from the charge removing light source are $1.0\times10^{12.71}\Omega$ and $1.0\times10^{12.30}\Omega$, respectively. Moreover, it is observed that the volume resistance values between the above two points show a decreasing trend from $1.0\times10^{12.71}\Omega$ toward $1.0\times10^{12.30}\Omega$.

The results of evaluations of the density, ghosting, and surface potential are shown in Table 2.

Example B4

A photoreceptor is prepared in a substantially same manner as that in Example B3, except that titanium oxide is used in place of zinc oxide in the coating solution B, and the density, ghosting and surface potential are evaluated in a manner as described in Example B3.

The volume resistivity, as measured in the same manner as in Example B1, of the sample of the coating solution B used for measuring light transmission is $1.0\times10^{10.5}$ (Ω·cm).

The volume resistance value of the subbing layer having a two-layer structure of Example B4 is measured at five points at predetermined intervals (60 mm), from one end to the other end of the aluminum substrate in the rotation axis direction Y. The volume resistance values at a portion closest to the charge removing light source and at a portion farthest from the charge removing light source are $1.0\times10^{12.71}\Omega$ and $1.0\times10^{12.99}\Omega$, respectively. Moreover, it is observed that the volume resistance values between the above two points show an increasing trend from $1.0\times10^{12.71}\Omega$ toward $1.0\times10^{12.99}\Omega$.

The results of evaluations of the density, ghosting, and surface potential are shown in Table 2.

TABLE 2

| | | Example B1 | Example B2 | Example B3 | Example B4 |
|---|---|---|---|---|---|
| Subbing layer A | Metal oxide particles | Zinc oxide | Zinc oxide | Zinc oxide | Zinc oxide |
| | Volume resistivity (Ω · cm) | $1.0 \times 10^{12.5}$ | $1.0 \times 10^{12.5}$ | $1.0 \times 10^{12.8}$ | $1.0 \times 10^{12.8}$ |
| | Thickness at closer side to charge removing light source | 16 | 16 | 16 | 16 |
| | Thickness at farther side from charge removing light source (μm) | 6 | 6 | 6 | 6 |

TABLE 2-continued

| | | Example B1 | Example B2 | Example B3 | Example B4 |
|---|---|---|---|---|---|
| Subbing layer B | Metal oxide particles | Zinc oxide | Titanium oxide | Zinc oxide | Titanium oxide |
| | Volume resistivity (Ω · m) | $1.0 \times 10^{10.0}$ | $1.0 \times 10^{10.3}$ | $1.0 \times 10^{10.8}$ | $1.0 \times 10^{10.5}$ |
| | Thickness at the closest position to charge removing light source (μm) | 6 | 6 | 6 | 6 |
| | Thickness at the fartherst position from charge removing light source (μm) | 16 | 16 | 16 | 16 |
| Total thickness (μm) | | 22 | 22 | 22 | 22 |
| Volume resistance value at the closest position to charge removing light source (Ω) | | $1.0 \times 10^{12.41}$ | $1.0 \times 10^{12.41}$ | $1.0 \times 10^{12.71}$ | $1.0 \times 10^{12.71}$ |
| Volume resistance value at the farthest position from charge removing light source (Ω) | | $1.0 \times 10^{11.99}$ | $1.0 \times 10^{11.99}$ | $1.0 \times 10^{12.30}$ | $1.0 \times 10^{12.99}$ |
| Difference in density (ΔD) | | 0.05 | 0.11 | 0.13 | 0.17 |
| Difference in surface potential (ΔV) | | 1.2 | 2.3 | 3 | 3.3 |
| Ghosting | | None | None | None | None |

All publications, patent applications, and technical standards mentioned in this specification are herein incorporated by reference to the same extent as if each individual publication, patent application, or technical standard was specifically and individually indicated to be incorporated by reference.

What is claimed is:

1. An image forming apparatus comprising:

an image holding member that is rotationally driven, the image holding member comprising, on a substrate, a subbing layer and a photosensitive layer, a volume resistance value of the subbing layer decreasing in a rotation axis direction of the image holding member, from one end portion of a light source side of the image holding member towards another end portion of the image holding member;

a charging unit that charges a surface of the image holding member;

a latent image formation unit that forms an electrostatic latent image on the image holding member by exposing to light the surface of the image holding member that has been charged by the charging unit;

a developing unit that forms a toner image corresponding to the electrostatic latent image on the image holding member by developing the electrostatic latent image with a toner;

a transfer unit that transfers the toner image onto an image receiving member; and a charge removal unit comprising the light source that, after transfer of the toner image, irradiates the surface of the image holding member from one side thereof, in a rotation axis direction of the image holding member, with charge removing light, to remove the charge from the surface of the image holding member.

2. The image forming apparatus of claim 1, wherein the thickness of the subbing layer decreases in a rotation axis direction of the image holding member, from one end portion of the light source side of the image holding member towards another end portion side of the image holding member.

3. The image forming apparatus of claim 1, wherein the thicknesses of the two end portions of the image holding member, in a rotation axis direction of the image holding member, each differ from the average thickness of the subbing layer in a rotation axis direction of the image holding member, by an amount of from about 10% to about 50% of the average thickness of the subbing layer.

4. The image forming apparatus of claim 1, wherein the volume resistivity of the subbing layer is from about $1.0\times10^{8}$ Ω·cm to about $1.0\times10^{15}$ Ω·cm.

5. The image forming apparatus of claim 1, wherein:

the subbing layer comprises a first subbing layer having a thickness that decreases, in a rotation axis direction of the image holding member, from one end portion of the light source side of the image holding member towards another end portion side of the image holding member; and a second subbing layer formed on or above the first subbing layer having a thickness that increases, in a rotation axis direction of the image holding member, from one end portion of the light source side of the image holding member towards another end portion side of the image holding member, and the thickness of the end portion of the light source side of the first subbing layer is larger than the thickness of the end portion of the light source side of the second subbing layer, and the thickness of the other end portion of the first subbing layer is less than the thickness of the other end portion of the second subbing layer.

6. The image forming apparatus of claim 5, wherein the volume resistivity of the first subbing layer is from about $1.0\times10^{8.2}$ Ω·cm to about $1.0\times10^{14.8}$ Ω·cm, and the volume resistivity of the second subbing layer is from about $1.0\times10^{14.8}$ Ω·cm to about $1.0\times10^{8.2}$ Ω·cm.

7. The image forming apparatus of claim 5, wherein the first subbing layer and the second subbing layer contain metal oxide particles of the same metal element.

8. The image forming apparatus of claim 7, wherein the first subbing layer and the second subbing layer have substantially the same composition but different dispersion states of the metal oxide particles.

9. The image forming apparatus of claim 1, wherein the image holding member is directly irradiated with charge removing light from the light source.

10. A process cartridge comprising:

an image holding member that is rotationally driven, the image holding member comprising, on a substrate, a subbing layer and a photosensitive layer, a volume resistance value of the subbing layer decreasing in a rotation axis direction of the image holding member, from one end portion of the light source side of the image holding member towards another end portion of the image holding member;

at least one selected from the group consisting of a charging unit that charges a surface of the image holding member, a latent image formation unit that forms an electrostatic latent image on the image holding member by exposing to light the surface of the image holding member that has been charged by the charging unit, a developing unit that forms a toner image corresponding to the electrostatic latent image on the image holding member by developing the electrostatic latent image with a toner, and a toner removal unit that removes the toner remaining on the surface of the image holding member; and a charge removal unit comprising the light source that, after transfer of the toner image, irradiates the surface of the image holding member from one side thereof, in a rotation axis direction of the image holding member, with charge removing light, to remove the charge from the surface of the image holding member.

11. The process cartridge of claim 10, wherein the thickness of the subbing layer decreases in a rotation axis direction of the image holding member, from one end portion of the light source side of the image holding member towards another end portion side of the image holding member.

12. The process cartridge of claim 10, wherein the thicknesses of the two end portions of the image holding member, in a rotation axis direction of the image holding member, each differ from the average thickness of the subbing layer in a rotation axis direction of the image holding member, by an amount of from about 10% to about 50% of the average thickness of the subbing layer.

13. The process cartridge of claim 10, wherein the volume resistivity of the subbing layer is from about $1.0\times10^{8}$ Ω·cm to about $1.0\times10^{15}$ Ω·cm.

14. The process cartridge of claim 10, wherein:

the subbing layer comprises a first subbing layer having a thickness that decreases, in a rotation axis direction of the image holding member, from one end portion of the light source side of the image holding member towards another end portion side of the image holding member; and a second subbing layer formed on or above the first subbing layer having a thickness that increases, in a rotation axis direction of the image holding member, from one end portion side of the light source side of the image holding member towards another end portion side of the image holding member, and the thickness of the end portion of the light source side of the first subbing layer is larger than the thickness of the end portion of the light source side of the second subbing layer, and the thickness of the other end portion of the first subbing layer is less than the thickness of the other end portion of the second subbing layer.

15. The process cartridge of claim 14, wherein the volume resistivity of the first subbing layer is from about $1.0\times10^{8.2}$ Ω·cm to about $1.0\times10^{14.8}$ Ω·cm, and the volume resistivity of the second subbing layer is from about $1.0\times10^{14.8}$ Ω·cm to about $1.0\times10^{8.2}$ Ω·cm.

16. The process cartridge of claim 14, wherein the first subbing layer and the second subbing layer contain metal oxide particles of the same metal element.

17. The process cartridge of claim 16, wherein the first subbing layer and the second subbing layer have the substantially same composition but different dispersion states of the metal oxide particles.

18. The process cartridge of claim 10, wherein the image holding member is directly irradiated with charge removing light from the light source.

* * * * *